US006461805B1

(12) United States Patent
Habu et al.

(10) Patent No.: US 6,461,805 B1
(45) Date of Patent: Oct. 8, 2002

(54) PHOTOTHERMOGRAPHIC MATERIAL

(75) Inventors: Takeshi Habu; Shu Nishiwaki; Tsuyoshi Mitsuhashi; Toshihisa Takeyama; Takuji Hasegawa, all of Hino (JP)

(73) Assignee: Konica Corporation

( * ) Notice: Subject to any disclaimer, the term of this patent is extended or adjusted under 35 U.S.C. 154(b) by 0 days.

(21) Appl. No.: 09/817,333

(22) Filed: Mar. 16, 2001

(30) Foreign Application Priority Data

Mar. 21, 2000 (JP) ..... 2000-077904

(51) Int. Cl.[7] ..... G03C 1/498

(52) U.S. Cl. ..... 430/619; 430/531; 430/533; 430/631

(58) Field of Search ..... 430/619, 531, 430/631, 203, 533

(56) References Cited

U.S. PATENT DOCUMENTS 5,856,062 A * 1/1999 Hoshi ..... 430/203

* cited by examiner

*Primary Examiner*—Thorl Chea
(74) *Attorney, Agent, or Firm*—Bierman, Muserlian and Lucas

(57) ABSTRACT

A photothermograpahic material is disclosed having light-sensitive silver halide grains, an organic silver salt, a reducing agent and a binder, wherein the photothermographic material comprises a silane compound represented by formula (1) or (2):

formula (1)

$$(R^1O)_m—Si—[(L_1)_xR^2]_n$$

formula (2)

formula 2 wherein $R^1$, $R^2$, $R^3$, $R^4$, $R^5$, $R^6$, $R^7$ and $R^8$ represent each an alkyl group, an alkenyl group, an alkynyl group, an aryl group or a heterocyclic group; $L_1$, $L_2$, $L_3$ and $L_4$ represent each a bivalent linkage group; m and n are each an integer of 1 to 3, provided that m+n is 4; p1 and p2 are each an integer of 1 to 3 and q1 and q2 are each 0, 1 or 2, provided that p1+q1 and p2+q2 are each 3; r1 and t are each 0 or an integer of 1 to 1000; and x is 0 or 1. The photothermographic material is used on a support.

8 Claims, 4 Drawing Sheets

PHOTOTHERMOGRAPHIC MATERIAL

FIELD OF THE INVENTION

The present invention relates to a photothermographic material, a preparation method thereof and a coating apparatus for use in the preparation thereof, whereby photothermographic material exhibiting superior photographic performance and storage stability, also having a layer strength sufficient to cause no abrasion mark, without causing uneven or non-uniform coating or coating coagulation.

BACKGROUND OF THE INVENTION

In the field of medical treatment and graphic arts, there have been problems in working property with respect to effluents produced from wet-processing of image forming materials, and recently, reduction of the processing effluent is strongly demanded in terms of environmental protection and space saving. Techniques meeting such demands are known, for example, as a method described in U.S. Pat. Nos. 3,152,904 and 3,487,075; and D. Morgan "Dry Silver Photographic Material" (Handbook of Imaging Materials, Marcel Dekker, Inc., page 48, 1991). Such photosensitive materials are usually thermally developed at a temperature of not less than 80° C., which are also called thermally developable photothermographic materials.

Most of such types of photothermographic materials have been manufactured through solvent-based coating, because in a light sensitive layer formed by coating an aqueous mixture of a developing agent and an organic silver salt, a water-mediated oxidation-reduction reaction gradually results, leading to an increase in fogging. Accordingly, there have been sought antifoggants but a useful one has not been yet obtained.

In water-based coating, an improvement or modification of binders has been attempted to reduce the moisture content in the dried layer. One technique thereof is the use of a hydrophobic latex capable of forming a coating layer exhibiting a reduced moisture content, as described in JP-A No. 10-207001, 10-221807, 10-221806, 11-119375 and 11-288068 (hereinafter, the term, JP-A means an unexamined, published Japanese Patent Application). However, to form a coating layer having a relatively low moisture content, sufficient drying is needed, disadvantageously retarding drying time.

Even in solvent-based coating, polar solvents are generally employed to enhance solubility of photographic additives and not a little water is carried therein, having an undesirable effect. Further, a silver halide used in the photothermographic material is formed in a water-based medium so that the photographic material necessarily contains a small amount of moisture, resulting in the undesirable influence of moisture.

Binder resistant to the influence of moisture contain no group capable of cross-linking, such as an amino or carboxy group, so that hardening agents capable of forming cross-linkage with the amino or carboxy group cannot be employed therein, leading to relatively low layer strength and leading to the disadvantage of being easily abraded. A technique for forming a coating layer exhibiting sufficient layer strength minimally affected by moisture is therefore desired.

SUMMARY OF THE INVENTION

In view of the foregoing, the present invention has been made and it is an object of the present invention to provide a photothermographic material exhibiting superior photographic performance, storage stability and moisture resistance, and not easy to be abraded, which is capable of compensating deteriorations in various performance, caused by limitations in the manufacturing process; and a manufacturing method and an apparatus for obtaining it.

The object of the invention can be accomplished by the following constitution:

A photothermographic material comprising on a support light sensitive silver halide grains, an organic silver salt, a reducing agent and a binder, wherein the photothermographic material further comprises a silane compound represented by formula (1) or (2):

formula (1):

$$(R^1O)_m—Si—[(L_1)_x R^2]_n \qquad \text{formula (1):}$$

formula (2)

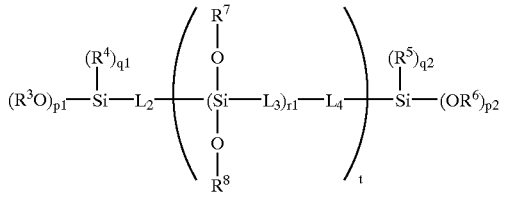

wherein $R^1$, $R^2$, $R^3$, $R^4$, $R^5$, $R^6$, $R^7$ and $R^8$ represent each an alkyl group, an alkenyl group, an alkynyl group, an aryl group or a heterocyclic group, which may be substituted; $L_1$, $L_2$, $L_3$ and $L_4$ represent each a bivalent linkage group; m and n each are an integer of 1 to 3, provided that m+n is 4; p1 and p2 are each an integer of 1 to 3 and q1 and q2 are each 0, 1 or 2, provided that p1+q1 and p2+q2 are each 3; r1 and t are each 0 or an integer of 1 to 1000; and x is 0 or 1.

U.S. Pat. Nos. 4,828,971 and 5,891,610 describe the use of a polysilicate compound. However, such a compound exhibits hydrolysis resistance higher than a polyalkoxysilane but has a disadvantage that the resulting dry layer easily causes cracking. With regard to modification of the layer surface of photothermographic materials, U.S. Pat. Nos. 3,489,567 and 3,885,965 disclose incorporation of a polysiloxane compound as a lubricant. However, such a compound enhances lubrication but does not enhance the surface layer strength of the photothermographic material, enough to improve abrasion resistance. Further, U.S. Patent discloses a silane compound to improve adhesion between a protective layer and a light sensitive layer. However, any of of the foregoing is distinct from the object, effects or the compound of the invention.

According to this invention, it was found that the use of a silane compound having a specific structure led to enhancements in photographic performance and layer strength. It was further found that the use of the compound relating to this invention enables uniform coating at a high speed by modification of a coating system.

DETAILED DESCRIPTION OF EMBODIMENTS OF THE INVENTION

Figure 1:
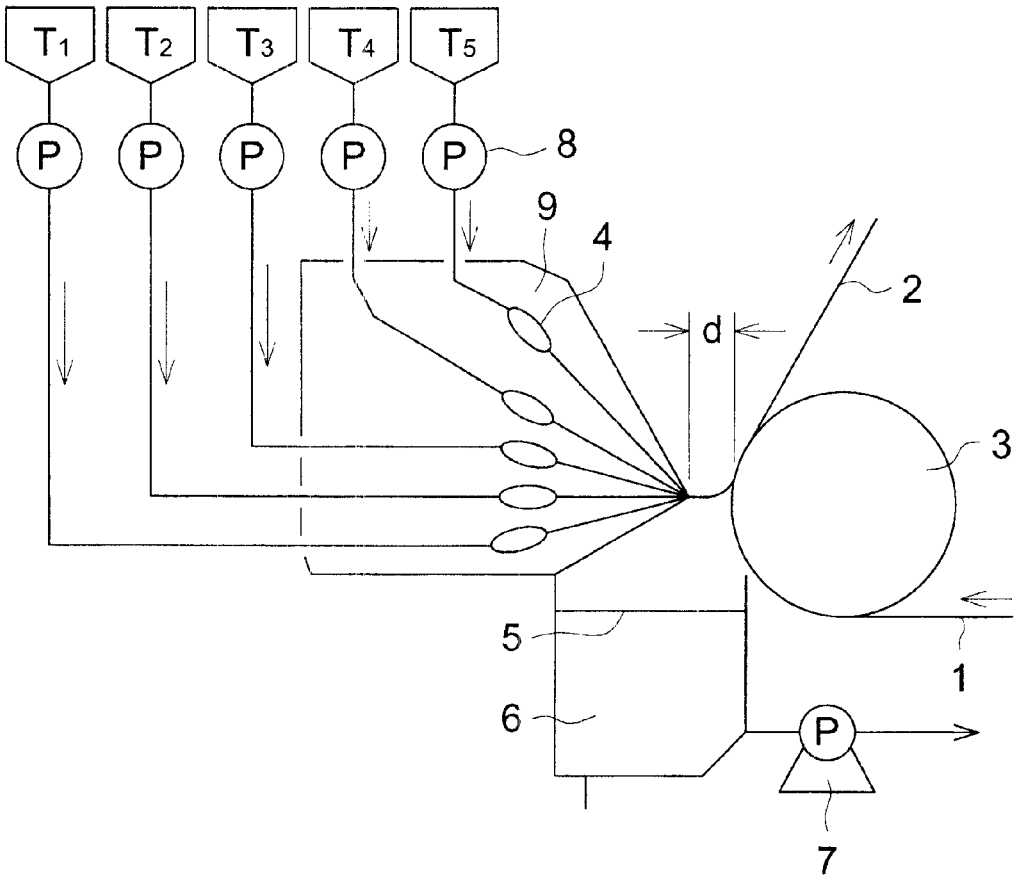
FIG. 1 illustrates an example of a vacuum simultaneous five-layer extrusion coating.

In this invention, the light sensitive layer containing silver halide grains of the photothermographic material further contains an organic silver salt, a reducing agent, an antifoggant, a print out-preventing agent, a binder and a cross-linking agent.

The silane compound represented by formula (1) or (2) functions as a crosslinking agent. In the formulas, $R^1$, $R^2$, $R^3$, $R^4$, $R^5$, $R^6$, $R^7$ and $R^8$ are each a straight chain, branched or cyclic alkyl group having 1 to 30 carbon atoms (e.g., methyl, ethyl, butyl, octyl, dodecyl, cycloalkyl, alkenyl group (e.g., propenyl, butenyl, nonanyl), an alkynyl group (e.g., acetylene group, bisacetylene group, phenylacetylene group), an aryl group (e.g., phenyl, naphthyl) or a heterocyclic group (e.g., tetrahydropyran, pyridyl group, furyl, thiophenyl, imidazolyl, thiazolyl, thiazolyl, oxadiazolyl). These groups may be substituted and substituent groups include any one of electron-withdrawing and electron-donating groups. Examples of the substituent groups include an alkyl group having 1 to 25 carbon atoms (e.g., methyl, ethyl, propyl, isopropyl, tert-butyl, pentyl, hexyl, cyclohexyl), halogenated alkyl group (e.g., trifluoromethyl, perfluorooctyl), cycloalkyl group (e.g., cyclohexyl, cyclopentyl), alkynyl group (e.g., propargyl group), glycidyl group, acrylate group, methacrylate group, aryl group (e.g., phenyl), heterocyclic group (e.g., pyridyl, thiazolyl, oxazolyl, imidazolyl, furyl, pyrrolyl, pirazinyl, pyrimidinyl, pirydazinyl, selenazolyl, sulforanyl, piperidinyl, pyrazolyl, tetrazolyl), halogen atom (chlorine, brominem iodine , fluorine), alkoxy group (methoxy, ethoxy, propyloxy, pentyloxy, hexyloxy), aryloxy (e.g., phenoxy), alkoxycarbonyl group (e.g., methyloxycarbonyl, ethyloxycarbonyl, butyloxycarbonyl), aryloxycarbonyl (phenyloxycarbonyl), sulfonamido group (methanesulfonamido, ethanesulfonamido, butanesulfoneamido, hexanesulfonamido, cyclohexanesulfonamido, benzenesulfonamido), sulfamoyl group (e.g., aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl), urethane group (e.g., methylureido, ethylureido, pentylureido, cyclohexylureido, phenylureido, 2-pyridylureido), acyl group (e.g., acetyl, propionyl, butanoyl, hexanoyl, cyclohexanoyl, benzoyl, pyridinoyl), carbamoyl group (e.g., amiocarbonyl, methylaminocarbonyl, dimethylaminocarbonyl, propylaminocarbonyl, pentylaminocarbonyl, cyclohexylaminocarbonyl, phenylaminocarbonyl, 2-pyridylamonpcarbonyl), amido group (acetoamide, propionamido, butaneamido, hexaneamido, benzamido), sulfonyl group (e.g., methylsulfinyl, ethylsulfinyl, butylsulfonyl, cyclohexylsulfonyl, phenylsulfinyl, 2-pyridylsulfonyl), amino group (e.g., amino, ethylamino, dimethylamino, butylamino, cyclopentylamino, anilino, 2-pyridylamino), cyano group, nitro group, sulfo group, carboxy group, hydroxy group and oxamoyl group. These substituent groups may be further substituted with the foregoing substituent groups.

$L_1$, $L_2$, $L_3$ and $L_4$ are each a bivalent linkage group, including an alkylene group (e.g., ethylene, propylene, butylenes, hexamethylene), oxyalkylene group (e.g., oxyethylene, oxypropylene, oxybutylene, oxyhexamethylene, or group comprised of plural these repeating units), aminoalkylene group (e.g., aminoethylene, aminopropylene, aminohexamethylene, or a group comprised of plural these repeating units), and carboxyalkylene group (e.g., carboxyethylene, carboxypropylene, carboxybutylene), thioether group, oxyether group, sulfonamido group and carbamoyl group.

At least one of $R^1$ and $R^2$ in formula (1), or at least one of $R^3$, $R^4$, $R^5$, $R^6$, $R^7$ and $R^8$ in formula (2) preferably is a ballast group (or a diffusion-proof group) or an adsorption-promoting group, and more preferably, $R^2$ is a ballast group or an adsorption-promoting group. The ballast group is preferably an aliphatic group having 6 or more carbon atoms or an aryl group substituted with an alkyl group having 3 or more carbon atoms. Introduction of the ballast group, depending on the amount of a binder or crosslinking agent, restrains diffusion at room temperature, preventing reaction during storage. The diffusion-proof can be evaluated in the following manner. A binder material is put into a capillary tube with opening ends and crosslinked. A sample material to be tested (i.e., analyte) is brought into contact with one opening end of the capillary and after being allowed to stand at a given temperature for a given period of time, the amount of the diffused sample material is determined by infrared spectroscopy, mass spectrometry, an isotope method or NMR spectrometry. The extent of diffusion can be determined by varying the temperature or time. Diffusion can be retard to levels of 1% to one hundred millionth by the molecular weight or introduction of a fixing group but also produces problems relating to an increase of the molecular weight or solubility of the fixing group, and it is therefore appropriate to introduce a group capable of retarding diffusion at room temperature to levels of 10% to one millionth.

The adsorption-promoting group can be evaluated by determining adsorption onto silver halide. Thus, a material to be tested (i.e., analyte) is added into a solution containing silver halide, after being allowed to stand, the silver halide is filtered and the solution is measured with respect to the remaining analyte to determine the adsorption amount onto silver halide. Adsorption depends on a silver ion concentration of the silver halide containing solution, the shape of silver halide and the silver halide grain size and it is preferred to make measurements under the condition close the shape, grain size and electrode potential of silver halide to be added together with an organic silver salt. For example, it is preferred that after cubic, octahedral or tabular silver iodobromide grains containing 0.1 to 10 mol % iodide and having an average grain size of 10 to 300 nm is allowed to stand at a pAg of 6 to 8, a temperature of 25±5° C. for a period of 1 to 48 hrs., the absorption amount is measured. Silver bromide or silver bromide grains containing no iodide may be used for measurement. In cases where coverage of the silver halide grain surface is calculated to be 3 to 10%, it is judge to be adsorptive. It is preferred to conduct the adsorption test using a silver halide emulsion not containing any one such as a dye, dyestuff, stabilizer and antifoggant, but a conventionally used silver halide emulsion containing a dye, stabilizer or antifoggant may be employed for the measurement. The adsorption-promoting group may be a group promoting adsorption onto silver halide containing a sulfur or nitrogen atom or a group containing an alkylene oxide group or carboxy group and containing no heteroatom. Preferred adsorption-promoting group a primary, secondary or tertiary amino group, an imidazole group, an oxazole group, a thiazole group or a tetrazole group.

$L_1$, $L_2$, $L_3$ and $L_4$ are each a bivalent linkage group, including, for example, —$CH^2$—, —$CF_2$—, =CF—, —O—, —S—, —NH—, —OCO—, —CONH—, —$SO_2$NH—, polyoxyalkylene group, thiourea group, polymethylene group and the combination of these groups.

In formula (1) or (2), m and n each are an integer of 1 to 3, provided that m+n is 4; p1 and p2 are each an integer of 1 to 3 and q1 and q2 are each 0, 1 or 2, provided that p1+q1 and p2+q2 are each 3; r1 and t are each 0 or an integer of 1 to 1000; and x is 0 or 1, and preferably 1.

The silane compound represented by formula (1) or (2) preferably contains a nitrogen atom, and more preferably a tertiary nitrogen, thereby promoting reaction (or hardening) or preventing coloration. Of the silane compounds represented by formula (1) or (2) preferred is the compound of formula (1).

Examples of the compound represented by formula (1) or (2) are shown below but are by no means limited to these.

1

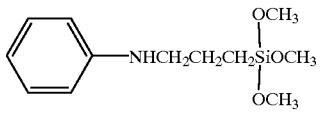

2

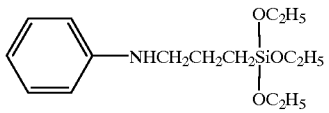

3

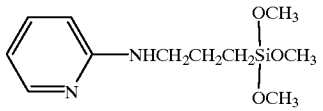

4

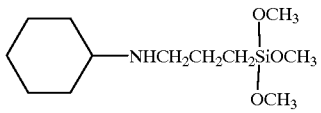

5

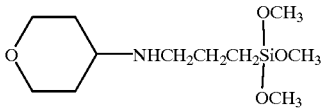

6

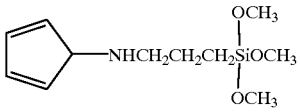

7

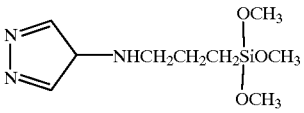

8

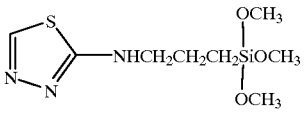

9

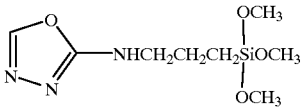

10

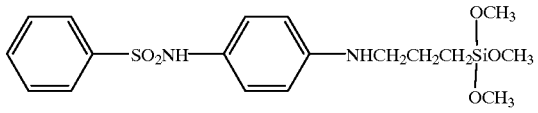

11

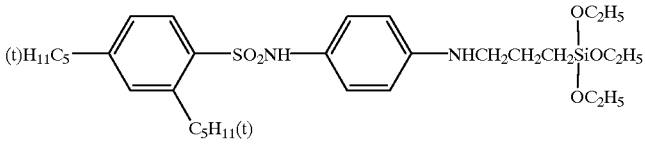

12

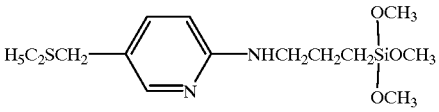

13

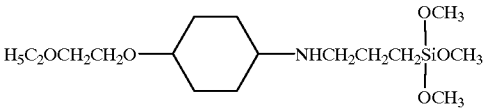

14

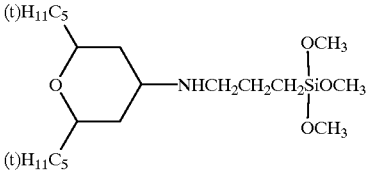

15

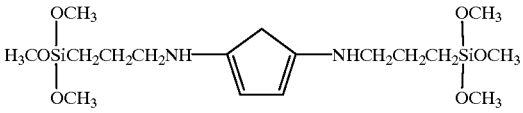

16

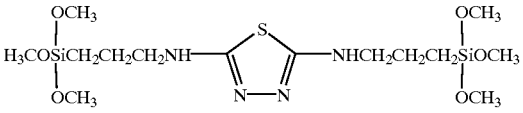

17

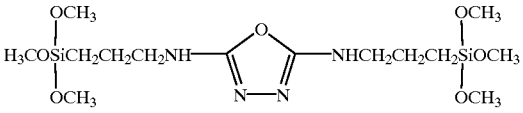

-continued
18
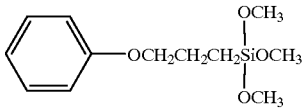
19
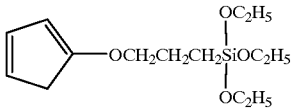
20
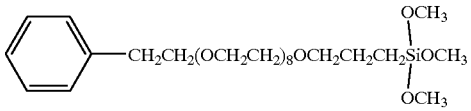
21
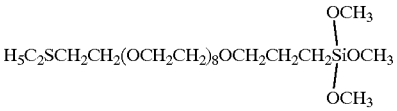
22
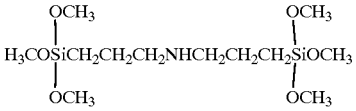
23
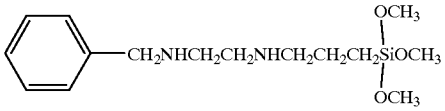
24
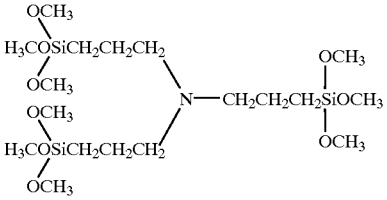
25
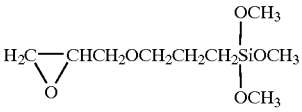
26
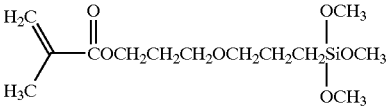
27
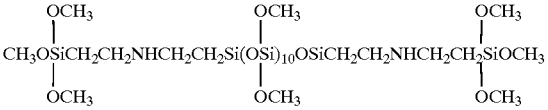
28
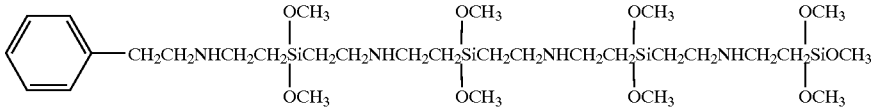
29
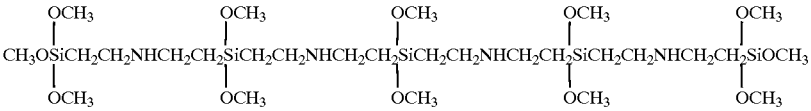
30
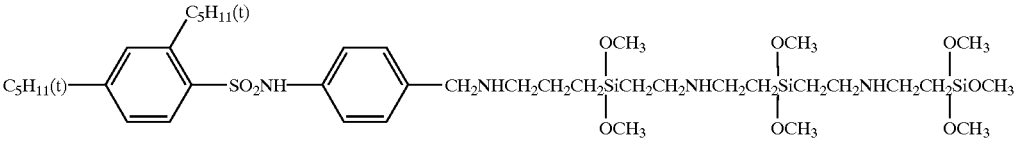
31
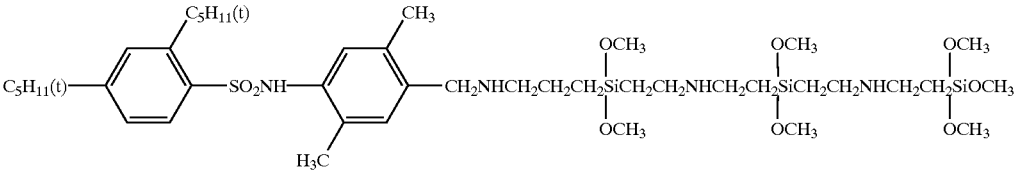
32
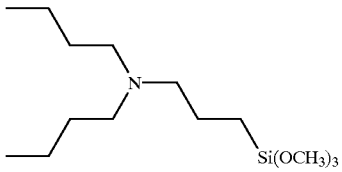
33
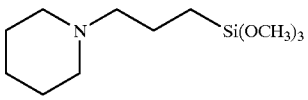

-continued

34

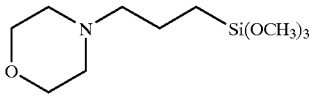

35

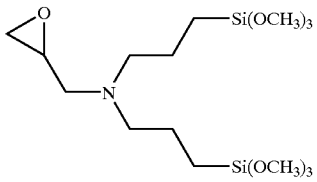

36

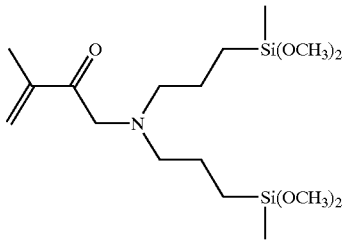

37

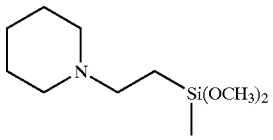

38

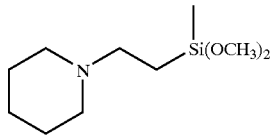

39

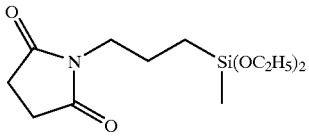

40

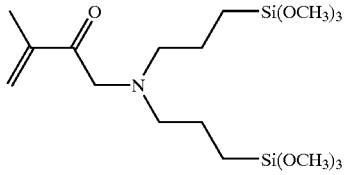

These silane compounds can be prepared in the manner that alkoxysilane compounds or silicon halides are used as a starting material, which are allowed to bond by a linkage group. The silane compound having a ballast group can be synthesized by allowing a ballast group to combine with a silane group.

The compound represented by formula (1) or (2) can be incorporated according to the method known in the art. Thus, the compound can be incorporated through solution in alcohols such as methanol and ethanol, ketones such as methyl ethyl ketone or acetone and polar solvents such as dimethylsulfoxide and dimethylformamide. The compound can also be incorporated by forming fine particles of 1 $\mu$m or less dispersed in water or an organic solvent, through sand mill dispersion, jet mil dispersion, ultrasonic dispersion or homogenizer dispersion. Further, there are also applicable a sand mill dispersion using glass beads or fine zirconia particle media and a dispersion method in which a solution is allowed to be ejected at a high speed from a canaliculus and be collided with a wall, or solutions ejected from two canaliculi are allowed to collide with each other. Such a fine particle dispersion preferably exhibits an average particle size of 1 nm to 10 $\mu$m in an aqueous solution and has a narrow particle distribution. Various techniques of fine particle dispersion are disclosed and dispersion can be conducted according thereto.

The silane compound of this invention is preferably incorporated into a layer containing additives such as silver halide, an organic silver salt or a reducing agent to react with a binder but may be incorporated into a layer adjacent to the layer containing the additives or an interlayer. Thus it is preferred to incorporate the silane compound into the light sensitive layer or a layer adjacent to the light sensitive layer, but the silane compound matalso incorporated into an interlayer or a subbed layer. The silane compound is incorporated preferably in an amount of $1\times10^{-8}$ to $1\times10^{-1}$, and more preferably $1\times10^{-5}$ to $1\times10^{-2}$ mol per mol of silver halide. In cases where incorporated into a layer containing no silver, the amount is determined as an amount per unit area. An excessive of the compound often causes reduction in sensitivity, contrast or maximum density, and in the case of being deficient, effects of this invention cannot be sufficiently achieved.

The coating method used in this invention includes organic solvent-based coating in which an organic solvent is employed to dissolve a binder, and water-based coating in which a binder in the form a latex or an aqueous binder solution is employed. The organic solvent-based coating refers to coating of solution containing organic solvent(s) accounting for 40 to 100%, specifically 70% or more of the total solvent(s). The organic solvents include, for example, non-polar solvents such as hexane, toluene and xylene and polar solvents such as methyl ketone, methyl isobutyl ketone, ethanol, and isopropyl alcohol. Polar solvents which are capable of dissolving a large amount of additives, are often empolyed.

The water-based coating refers to coating of an aqueous solution containing organic solvent(s) which accounting 0 to 40%, preferably not more tha 20%, more preferably not more than 10%, and still more preferably not more than 5% of the total solvents.

Binders usable on the organic solvent-based coating include cellulose derivatives, polyimide derivatives, polyamide derivatives and polyester derivatives. Of these, polyvinyl alcohol derivatives and vinyl acetate derivatives are preferred. A polyvinyl alcohol derivative represented by formula (3) is specifically preferred:

formula (3):

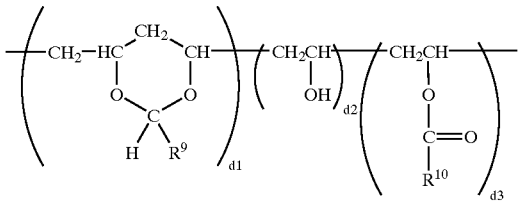

wherein $R^9$ and $R^{10}$ each represent an alkyl group, alkenyl group, aryl group or a heterocyclic group; d1, d2 and d3 represent a constitution ratio and d1 is 20 to 96% by weight, d2 is 1 to 40% by weight and d3 is 0.1 to 80% by weight.

In formula (3), $R^9$ and $R^{10}$ represents an alkyl group (preferably having 1 to 12 carbon atoms) such as methyl, ethyl, butyl, hexyl, cyclohexyl, octyl and dodecyl; an alkenyl group such as propenyl, butenyl, octenyl and dodecenyl; an alkynyl group such acetylenyl and bisacetylenyl; an aryl group such as phenyl and naphthyl; and a heterocyclic group such as pyridyl, piperidyl, furyl, pyranyl, thiophenyl, pyrrolyl, pyrrolidonyl, imidazolyl, triazolyl, thidiazolyl, oxadiazolyl, tetrazolyl, and pyrimidyl. These groups may be substituted with substituent group(s). Examples of the substituent group are the same as defined in $R^1$ through $R^8$ of formulas (1) and (2).

The molecular weight of the polymeric compound of formula (3) is preferably 800 to 800,000, and more preferably 10,000 to 400,000. In the case of the molecular weight being smaller, sufficient layer strength cannot be obtained and in the case of the molecular weight being larger, solubility is lowered and the viscosity is excessively increased, so that it is preferred to adjust an optimum viscosity so as to fit the additive containing solution. The acetalized portion accounting for $d_1$ percent by weight include not only intramolecularly acetalized portions but also intermolecularly acetalized portions. Intermolecularly acetalized polyvinyl alcohol derivatives can be prepared in such a manner that when undergoing acetalization by adding aldehydes to polyvinyl alcohol, the polyvinyl alcohol or aldehydes are allowed to react at a relatively high concentration, the amount of an acetalization catalyst is increased, the catalyst is added at the later stage of the reaction, or the reaction temperature or stirring speed is increased. The stirring speed is preferably within a Reynolds number of 1,000 to 10,000. The intermolecularly acetalized polymer preferably account for 0.1 to 60%, more preferably 1 to 30%, and still more preferably 3 to 20% of the total polymer. These ranges are preferred in terms of the viscosity of a coating solution being easily adjustable and the formed layer film being elastic without weakening the layer strength. The proportion of the intermolecular acetal can be determined by liquid chromatography (Gel Permeation Chromatography) or the viscosity measurement method. Preparation and analysis of intermolecular acetals are referred to JP-A 6-25213.

The structure of an intermolecular acetal is represented by the following formula (4):

formula (4):

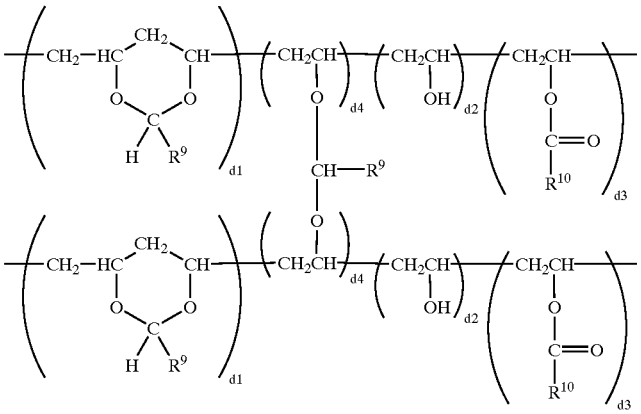

wherein $R^9$, $R^{10}$, d1, d2 and d3 are the same as defined in formula (3), and d4 represents a percentage by weight of intermolecular acetals. Thus, d4 is 0.01 to 5% by weight.

In water-based coating, water-soluble polymers or aqueous-dispersed hydrophobic polymers (latexes) are preferably employed. Examples thereof include polyvinylidene chloride, vinylidene chloride-acrylic acid copolymer, vinylidene chloride-itacinic acid copolymer, poly(sodium acrylate), polyalkyleneoxide, acrylic acid amide-acrylic acid ester copolymer, styrene-anhydrous maleic acid copolymer, acrylonitrile-butadiene copolymer, vinyl chloride-vinyl acetate copolymer and styrene-butadiene-acrylic acid copolymer. These polymers constitutes a water-based coating solution, which is coated and dried to form a uniform polymer film at the stage of film-forming. Thus, an aqueous dispersion of an organic silver salt, silver halide, reducing agent and the like is mixed with such a latex to form a uniform dispersion and coated to form a photothermographic layer. Latex particles coagulates upon drying to form a uniform film.

Polymers exhibiting a glass transition point of −20° C. to 80° C., and specifically −5° C. to 60° C. are preferred. The higher glass transition point leads to elevation of developing temperature, and the lower transition point results in an increase in fogging and a decrease in sensitivity or contrast.

The aqueous-dispersed polymer is preferably comprised of fine particles having an average size of 1 to a few μms, dispersed in water. The aqueous-dispersed hydrophobic polymer is called a latex and among binders used in water-based coating, such a latex is preferred in terms of enhanced water resistance. The more latex is the better o enhance water resistance. The content of a latex is preferably 50 to 100%, and more preferably 80 to 100%, based on total binder. Examples of aqueous-dispersed latexes are shown in Table 1, including vinylidene chloride type, styrene type, butadiene type and acryl type. In the Table, St represents styrene; Bu, butadiene; MA, methyl acrylate; INA, isononyl acrylate; CA, cyclohexyl methacrylate; HEA, hydroxyethyl acrylate; AA, acrylic acid; MAA, methacrylic acid; IA, itaconic acid; AAm, acrylamide; St-S, styrensufonic acid; AMPS, acrylamido-2-methylpropanesufonic acid amide; IP-S, isoprenesulfonic acid; PF-S, 2-propenyl-4-nonylphenoxyethyleneoxide(n=10)-sulfonic acid easter; MMA, metylmethacrylate; and EA, ethyl acrylate.

TABLE 1

| Latex No. | Constituent 1 (wt%) | Constituent 2 (wt%) | Constituent 3 (wt%) | Constituent 4 (wt%) | Constituent 5 (wt%) |
|---|---|---|---|---|---|
| L1 | St (70) | Bu (30) | — | — | — |
| L2 | St (50) | Bu (47) | AA (3) | — | — |
| L3 | St (40) | Bu (58) | MAA (2) | — | — |
| L4 | St (30) | Bu (69) | IA (1) | — | — |
| L5 | St (60) | MMA (20) | EA (19) | AA (1) | — |
| L6 | St (60) | MMA (15) | EA (24) | AA (1) | — |
| L7 | St (60) | MMA (30) | EA (8) | AA (1) | — |
| L8 | St (60) | MMA (20) | MA (19) | AA (1) | — |
| L9 | MMA (65) | INA (34) | AMPS (1) | — | — |
| L10 | MMA (65) | INA (34) | IP-S (1) | — | — |
| L11 | MMA (65) | INA (34) | PF-S (1) | — | — |
| L12 | MMA (65) | INA (20) | EA (15) | — | — |
| L13 | MMA (60) | INA (20) | BU (19.5) | AA (0.5) | — |
| L14 | MMA (60) | INA (20) | BU (19.5) | MMA (0.5) | — |
| L15 | MMA (60) | CA (20) | BU (18.5) | IA (0.5) | St-S (1) |
| L16 | MMA (65) | CA (20) | Bu (12) | HEA (2) | AA (1) |
| L17 | MMA (65) | CA (20) | Bu (11) | HEA (2) | AMPS (2) |
| L18 | MMA (65) | CA (20) | Bu (10) | HEMA (2) | MAA (3) |
| L19 | MMA (65) | CA (20) | Bu (12) | AAm (2) | IP-S (1) |
| L20 | MMA (65) | CA (20) | Bu (12) | AAm (2) | PF-S (1) |

The content of polymer binder (in the case of a latex, solids content) is preferably one fourth to ten times silver coverage, and more preferably a half to 7 times silver coverage. In the case of silver coverage of 2.0 g/m$^2$, the coating amount of a polymer is preferably 0.5 to 20 g/m$^2$, and more preferably 1.0 to 14 g/m$^2$. In the case of less than one fourth of silver coverage, silver image tone is markedly deteriorated and unacceptable in practical use, and in the case of more than ten times silver coverage, contrast is markedly decreased and unacceptable in practical use.

Binders used in the photothermographic material give photothermographic components such as silver halide, organic silver salt and reducing agent a reaction site to proceed an optimum oxidation-reduction reaction of silver halide.

Next, there will be described other constituent in the photothermographic material used in this invention. As an organic acid of an organic silver salt employed are fatty acids such as stearic acid, behenic acid and palmitic acid.

Light sensitive silver halide emulsions usable in the photothermographic materials according to the invention can be prepared according to the methods commonly known in the photographic art, such as single jet or double jet addition, or ammoniacal, neutral or acidic precipitation. Thus, the silver halide emulsion is prepared in advance and then the emulsion is mixed with other components of the invention to be incorporated into the composition used in the invention. To sufficiently bring the photosensitive silver halide into contact with an organic silver salt, there can be applied such techniques that polymers other than gelatin, such as polyvinyl acetal are employed as a protective colloid in the formation of photosensitive silver halide, as described in U.S. Pat. Nos. 3,706,564, 3,706,5653,713,833 and 3,748,143, British Patent 1,362,970; gelatin contained in a photosensitive silver halide emulsion is degraded with an enzyme, as described in British Patent 1,354,186; or photosensitive silver halide grains are prepared in the presence of a surfactant to save the use of a protective polymer, as described in U.S. Pat. No. 4,076,539.

Silver halide used in the invention functions as a highly light sensitive material. Silver halide grains are preferably small in size to prevent milky-whitening after image formation and obtain superior images. The grain size is preferably not more than 0.1 μm, more preferably, 0.01 to 0.1 μm, and still more preferably, 0.02 to 0.08 μm. The form of silver halide grains is not specifically limited, including cubic or octahedral, regular crystals and non-regular crystal grains in a spherical, bar-like or tabular form. Halide composition thereof is not specifically limited, including any one of silver chloride, silver chlorobromide, silver iodochlorobromide, silver bromide, silver iodobromide, and silver iodide. The content of silver halide is preferably not more than 50%, more preferably 0.1 to 25%, and still more preferably 0.1 to 15%, based on the total amount of an organic silver salt.

Light sensitive silver halide used in the thermally developable photosensitive material of the invention can be formed simultaneously with the formation of organic silver salt by allowing a halide component such as a halide ion to concurrently be present together with organic silver salt-forming components and further introducing a silver ion thereinto during the course of preparing the organic silver salt.

Alternatively, a silver halide-forming component is allowed to act onto a pre-formed organic silver salt solution or dispersion or a sheet material containing an organic silver salt to convert a part of the organic silver salt to photosensitive silver halide. The thus formed silver halide is effectively in contact with the organic silver salt, exhibiting favorable actions. In this case, the silver halide-forming component refers to a compound capable of forming silver salt upon reaction with the organic silver salt. Such a compound can be distinguished by the following simple test. Thus, a compound to be tested is to be mixed with the organic silver salt, and if necessary, the presence of a peal specific to silver halide can be confirmed by the X-ray diffractometry, after heating. Compounds that have been confirmed to be effective as a silver halide-forming component include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Examples thereof are inorganic halide compounds: e.g., a halide compound represented by formula, MXn, in which M represents H, NH4 or a metal atom; n is 1 when M is H or NH4 and a number equivalent to a valence number of the metal atom when M is the metal atom; the metal atom includes lithium, sodium, potassium, cesium, magnesium, calcium, strontium, barium, zinc, cadmium, mercury, tin, antimony, chromium, manganese, cobalt, rhodium, and cerium, and molecular halogen such as aqueous bromine being also effective.

The silver halide-forming component is used stoichiometrically in a small amount per organic silver salt. Thus, it is preferably 0.001 to 0.7 mol, and more preferably 0.03 to 0.5 mol per mol of organic silver salt. The silver halide-forming component may be used in combination. Conditions including a reaction temperature, reaction time and reaction pressure during the process of converting a part of the organic silver salt to silver halide using the silver halide forming component can be appropriately set in accordance with the purpose of preparation. The reaction temperature is preferably −20° C. to 70° C., the reaction time is preferably 0.1 sec to 72 hrs. and the reaction pressure is preferably atmospheric pressure. The reaction is performed preferably in the presence of polymer as a binder, wherein the polymer to be used is preferably 0.01 to 100 weight parts, and more preferably 0.1 to 10 weight parts per 1 weight part of an organic silver salt.

The thus formed light sensitive silver halide can be chemically sensitized with a sulfur containing compound, gold compound, platinum compound, palladium compound, silver compound, tin compound, chromium compound or their combination. The method and procedure for chemical sensitization are described in U.S. Pat. No. 4,036,650, British Patent 1,518,850, JP-A 51-22430, 51-78319 and 51-81124. As described in U.S. Pat. No. 3,980,482, a low molecular weight amide compound may be concurrently present to enhance sensitivity at the time of converting a part of the organic silver salt to photosensitive silver halide.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. Such metal complexes and metal complex ions are preferably a six coordinate complex ion.

Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. Particularly preferred examples of M include Rh, Ru, Re, Ir and Os.

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole. Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side.

In cases where a light insensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into any layer. In order to accomplish the object of the present invention, the matting agent is preferably incorporated into the layer other than the photosensitive layer layer, and is more preferably incorporated into the farthest layer from the support.

Addition methods of the matting agent include those in which a matting agent is previously dispersed into a coating composition and is then coated, and prior to the completion of drying, a matting agent is sprayed. When plural matting agents are added, both methods may be employed in combination. The content of a matting agent is optimally selected at levels of causing no haze, and preferably is 0.01 mg/m2 to 1 g/m$^2$.

The photothermographic material used in this invention comprises a reducible silver source (e.g., organic silver salt), a catalytically active amount of photocatalyst (e.g., silver halide) and a reducing agent which are dispersed in an organic binder matrix. The photothermographic materials are stable at ordinary temperature and forms silver upon heating, after exposure, at a relatively high temperature (e.g., 80 to 140° C.) through an oxidation-reduction reaction between the reducible silver source (which functions as an oxidizing agent) and the reducing agent. The oxidation-reduction reaction is accelerated by catalytic action of a latent image produced by exposure. Silver formed through reaction of the reducible silver salt in exposed areas provides a black image, which contrasts with non-exposes areas, leading to image formation. This reaction process proceeds without being supplied with water from the exterior.

The photothermographic material of this invention comprises a support having thereon at least one photosensitive layer. Further, at least one non-photosensitive layer is preferably formed on the photosensitive layer. In order to control the amount or wavelength distribution of light transmitted through the photosensitive layer, a filter layer may be provided on the same side as the photosensitive layer, and/or an anti-halation layer, that is, a backing layer on the opposite side. Dyes or pigments may also be incorporated into the photosensitive layer.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and JP-A 59-57234. Examples of preferred antifoggants are those described in column [0062] to [0063] of JP-A 9-90550. Further, other preferred antifoggants are those described in U.S. Pat. No. 5,028,523, European Patent No. 600,587, 605,981 and 631,176.

In the thermally processable photosensitive material of the present invention, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978). Particularly, selected can advantageously be sensitizing dyes having the spectral sensitivity suitable for spectral characteristics of light sources of various types of scanners. For example, compounds described in JP-A Nos. 9-34078, 9-54409 and 9-80679 are preferably employed.

The photothermographic material may optionally be added with a sensitizer, an organic or inorganic filler, a surfactant, an anti-staining agent, a UV absorbent, an antioxidant, water-proofing agent, a dispersing agent, a stabilizer, a plasticizer, a coating aid, a de-foaming agent, a fluorescent dye and a meal salt of fatty acid.

To adjust gradation, layers may be arranged in such a manner as a high-speed layer/low-speed layer or a low-speed layer/high-speed layer. Further, various additives may be incorporated into either the light-sensitive layer or light-insensitive layer, or both of them.

As a support usable are paper, synthetic paper, non-woven fabric, metal foil, plastic resin film and composite films by the combination thereof.

Coating solutions used in this invention can be prepared in the following manner. Thus, a coating solution can be obtained by mixing a dispersion containing the silane compound relating to this invention together with a binder, a dispersion containing an organic silver salt, a silver halide, a reducing agent and a binder, and a solution or dispersion containing additive(s), together with a binder. Then, the coating solution is coated on the support and dried to obtain a photothermographic material. Alternatively, an instantaneously mixing and adding method may be employed, in which the silane compound is added to the coating solution immediately before coating, using a static mixer. In this method, the period for reacting with a binder contained in the coating solution is so short that variation in physical property of the coating solution such as viscosity and surface tension is less that the previously mixed coating solution described above, advantageously having little influence on photographic performance. This period of time, depending on the pipe length and diameter, and the supplying rate in a supplying system of from the addition position to a die of a coating solution, is preferably 0.001 to 10 min, and more preferably within 2 min. The temperature preferably fits the coating solution temperature range of 5 to 50° C. and may be within +15° C. of the coating solution temperature. Larger differences in temperature, which make it difficult to precisely control the solution temperature or viscosity, should be avoided.

Figure 2:
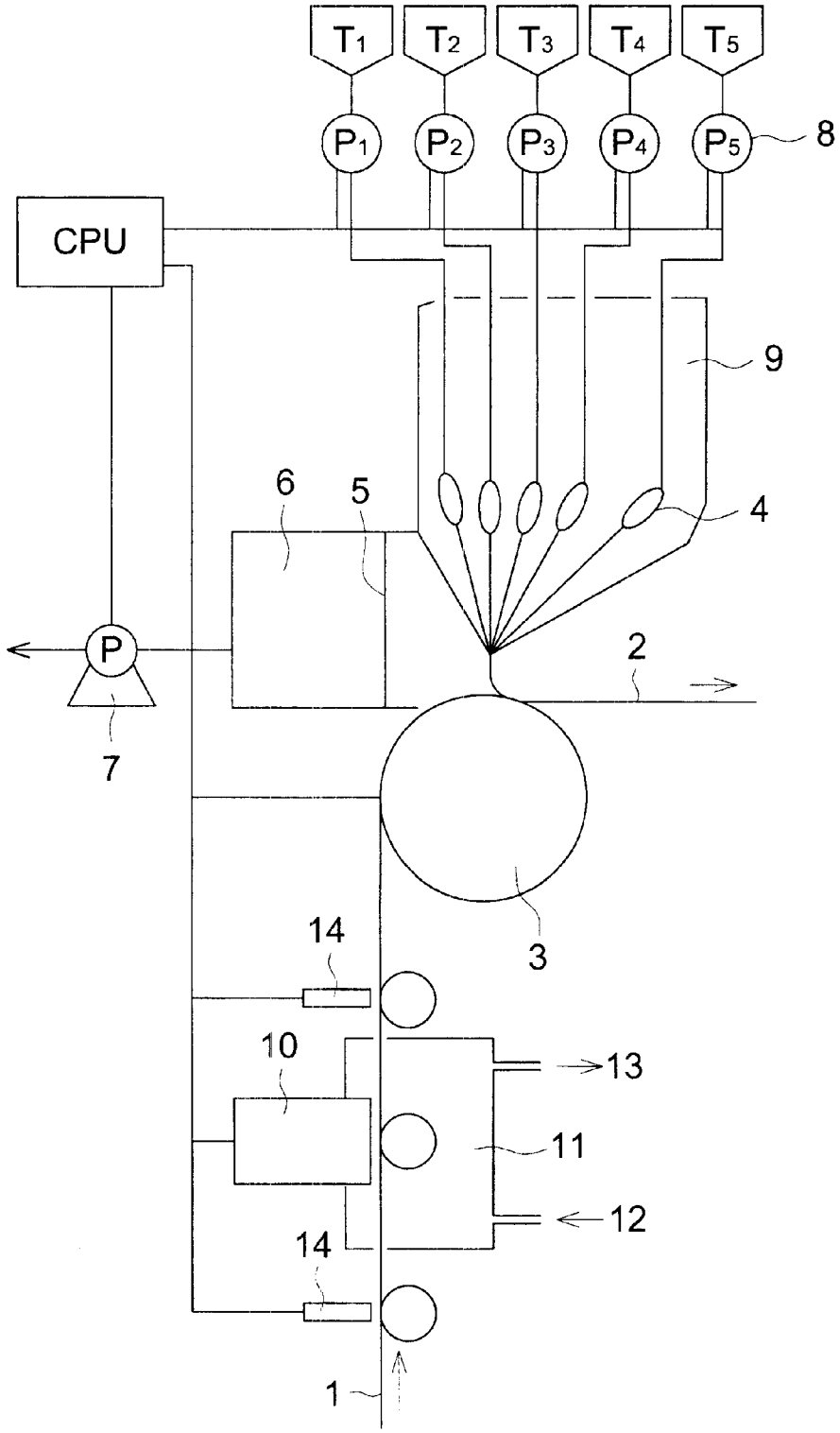
FIG. 2 also illustrates another example of a vacuum simultaneous five-layer extrusion coating.

An usable coating system can be optimally selected from various coating systems such as a slide hopper system, wire-bar system, roll coater system and vacuum extrusion system. Of these coating systems, the vacuum extrusion system is preferred, as shown in FIGS. 1 and 2. FIGS. 1 and 2 illustrate a side view of a vacuum extrusion coater simultaneously coating five layers. A single layer vacuum extrusion coating apparatus can be prepared referring to JP-A No. 11-207236 and based on this method, five solutions are superposed in the die and extruded. FIG. 1 shows the solutions being horizontally extruded and FIG. 2 shows the solutions being vertically extruded. The extrusion angle is optionally set between 0 to 90°, for example, the extrusion angle can be set to 45°. The vertically flowing system shown in FIG. 2 is preferred to achieve a stable supply. In this invention, uniform coating can be conducted at a high speed without causing coating unevenness.

In FIG. 1, support 1 is horizontally introduced with respect to a support-driving roll 3 and five solutions are supplied from die 9 and discharged in the direction of 2. The five solutions are supplied to addition vessels $T_1$ through $T_5$ and allowed to pass through a stabilizing chamber 4 to stabilize supply of the coating solutions in the die by an extrusion pump 8 and is discharged from the top of the die. The distance d between the top of the die and the support on the support-driving roll is called the bead distance, which is maintained preferably at 20 to 600 $\mu$m. and more preferably 80 to 300 $\mu$m. Reduced pressure chamber 6 having bulkhead 5 is provided under the bead, in which the reduced pressure is maintained by a vacuum pump 7. The reduced pressure is maintained at a pressure by 10 to 400 hPa less, and preferably 30 to 300 hPa less than atmospheric pressure.

Figure 4A:
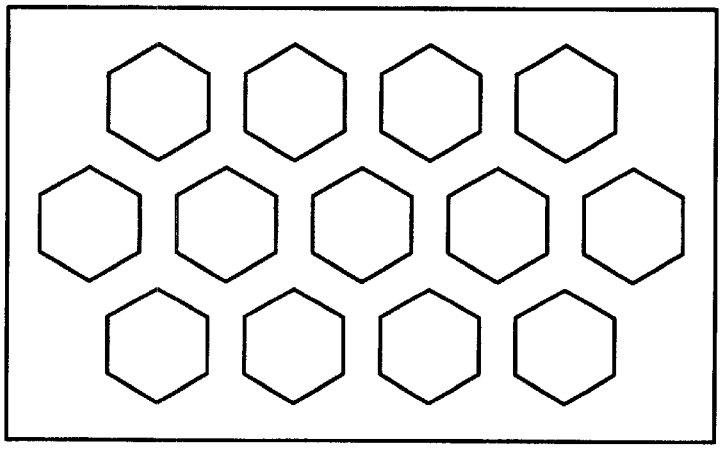
FIG. 4 shows the shape of penetration pores.
Figure 4B:
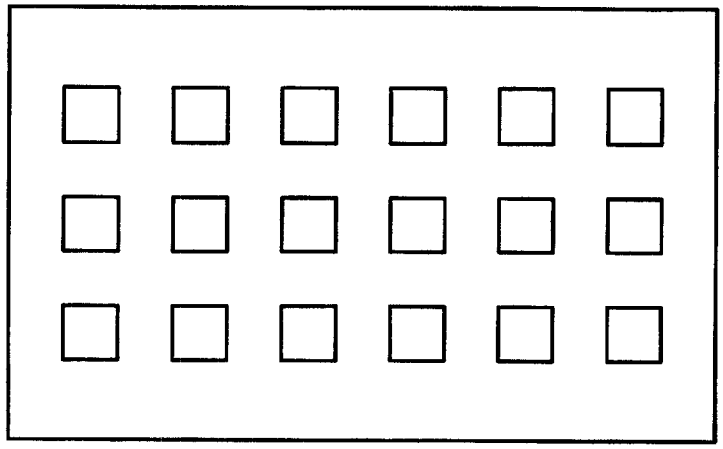
Figure 4C:
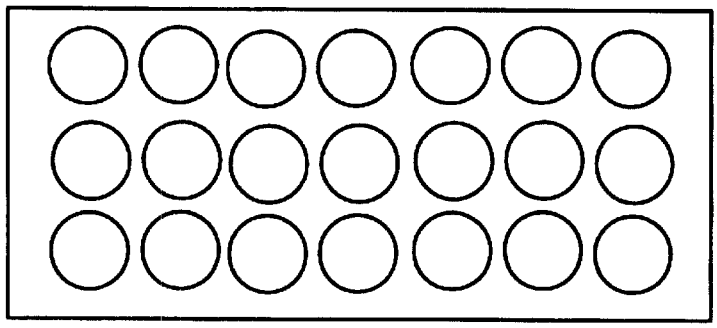

Bulkhead 5 in reduced pressure chamber 6 is provided so that the pressure is uniformly reduced in the bead portion. In the FIG. 1, it is provided parallel to the discharging direction of the coating solution but may also be provided vertically. Alternatively, a multi-step bulkhead having plural bulkheads may be provided. To achieve uniform coating without causing unevenness, fine penetration pores may be provided in the bulkhead, thereby resulting in the reduced pressure under the bead to be more uniform. The shape of the penetration pores can be selected from a lattice form, a circular form and a honeycomb form, as shown in FIG. 4. The total area of the penetration pores preferably accounts for 1 to 90% of the bulkhead area. The diameter of a circle having an area identical to the area of a single pore is calculated to determine the mean diameter of the total pores. The mean diameter is preferably 100 Å to 1 cm, more preferably 100 nm to 1 mm, and still more preferably 5 $\mu$m 500 $\mu$m. The distance between the bulkhead and the bead portion is optional, preferably 100 $\mu$m to 1 m, more preferably 1 mm to 60 cm, and still more preferably 5 mm to 30 cm. The pore size may not necessarily be uniform from the inlet to the outlet but may have plural diameters or may be different between the end and the center.

Stabilizing chamber 4, for supplying a coating solution, restrains the turbulent flow of the coating solution, which may be single or plural chambers. The shape of its cross section is optionally selected from a sphere form, an ellipsoid form, a spindle form, a rectangular solid form, a cubic form, and combinations thereof. Of these, the ellipsoid or spindle form is preferred. The viscosity of solutions used in simultaneous multi-layer coating is within the range of 0.01 to 1000 mpa·s, and preferably 0.1 to 100 mpa·s. In this case, the viscosity of the layer closest to or farthest from the support is preferably 1 to 100 nPa·s. In the case of three or more layers, the largest viscosity, specifically the viscosity of the light sensitive layer is preferably 100 mpa·s or more. In cases when the viscosity exceeds this range, flowability of the coating solution is lowered and no coating can be achieved or uniform coating cannot be achieved. The viscosity can be adjusted with a thickening agent comprised of a polymer but the viscosity is also adjustable by varying the molecular weight or the molecular weight distribution, without lowering the layer strength. In this invention, the viscosity is adjusted preferably using the compound represented by formula (3) or (4).

Figure 3:
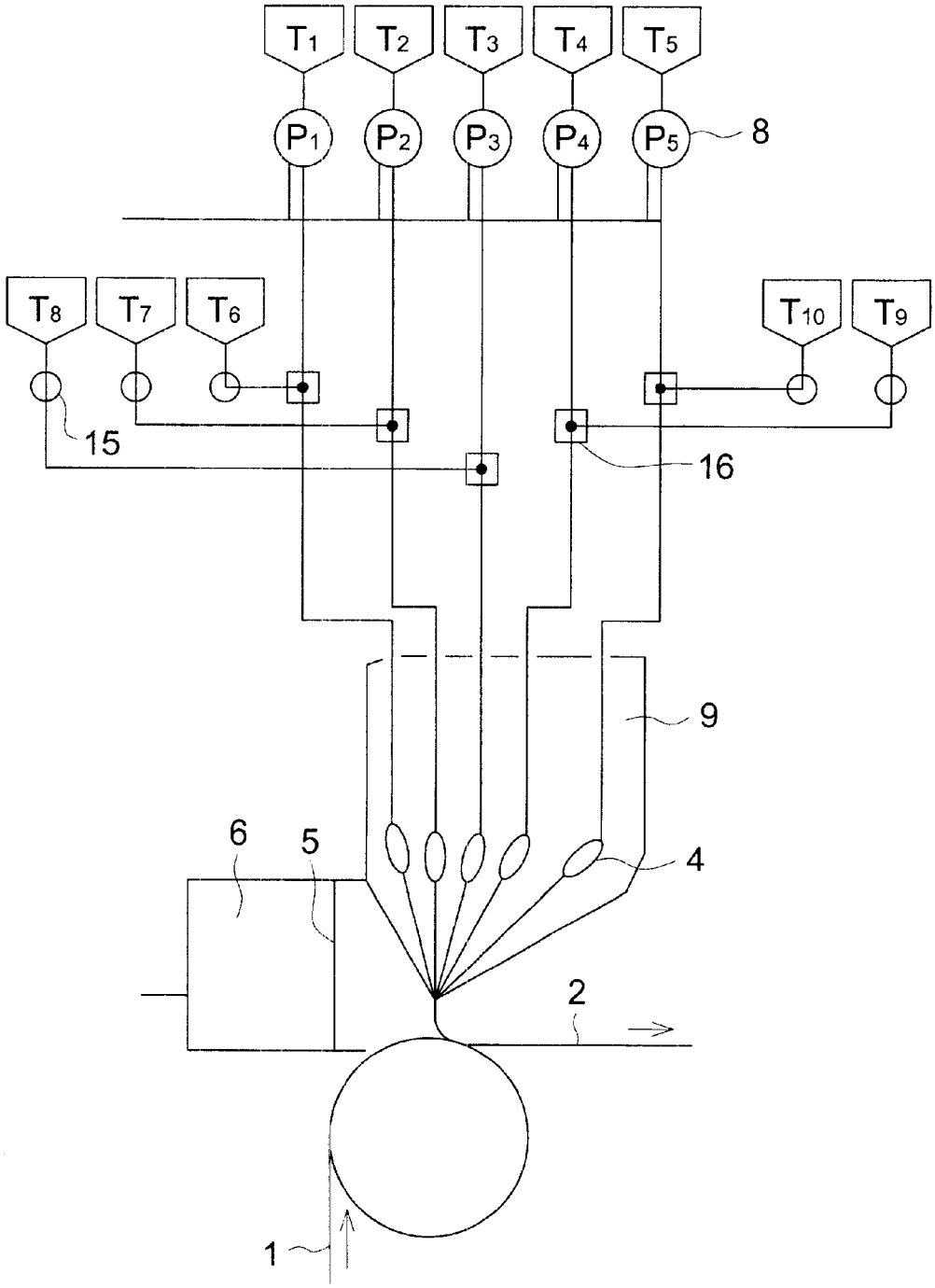
FIG. 3 shows the case of separate addition of additives in coating shown in FIG. 2.

Coating solutions containing various additives are prepared and then coated. In FIG. 2, there are also shown a menas for corona discharge or plasma treatment (10), inert gas chamber (11), gas inlet and out let (12, 13) and means for discharging (14). In cases where being affected by other additives, addition vessels $T_6$ through $T_{10}$ are separately provided as shown in FIG. 3 and solutions are supplied by pump 15 to be mixed immediately before coating. After two solutions were mixed, the mixture can be further sufficiently mixed using static mixer 16 provided in each line.

It is preferred to subject a support or a subbed support to a corona discharge treatment or plasma treatment before a coating solution is sullied thereto. Before and after such treatments, it is also preferred to conduct a discharge treatment. The discharging treatment before the corona treatment or plasma treatment can enhance uniformity or effects of the corona or plasma treatment and the discharging treatment after the corona treatment or plasma treatment results in uniform supply of a coating solution onto the support. The extent of the corona or plasma treatment can be adjusted by measuring a contact angle on the surface. The contact angle is preferably within the range of variation of 2 to 70 degrees with respect to water. Instead of the contact angle, it is also adjustable by the level of layer-adhesion. The energy value in the adjustment is preferably within the range of 0.1 mW to 100 kW/m$^2$·min., and more preferably 10 mW to 1 kW/m$^2$·min. In case when falling below this range, it is difficult to achieve uniform coating and when exceeding this range, unevenness is caused. The plasma treatment is preferably a flame type treatment and although the plasma treatment under atmospheric pressure is simple, the treatment under reduced pressure leads to better results. Examples of usable inert gas include argon, neon, helium and nitrogen and of these, argon is preferred. Combustion gases to be mixed include, for example, town gas, natural gas, propane gas and butane gas. The discharging treatments include, for examples, an ion wind type, an electrode type, discharging bar type, a discharging plate and a discharging fabric. The charging amount can be determined by measuring voltage of static capacity using a electrostatic charge meter.

In this invention, exposure is preferably conducted by laser scanning exposure. It is also preferred to use a laser exposure apparatus, in which a scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photosensitive material is scanned with laser light, the-beam spot diameter on the surface of the photosensitive material is preferably not more than 200 μm, and more preferably not more than 100 μm. Thus, a smaller spot diameter preferably reduces the angle displacing from verticality of the laser incident angle. The lower limit of the beam spot diameter is 10 μm. The thus laser scanning exposure can reduce deterioration in image quality due to reflected light, resulting in occurrence such as interference fringe-like unevenness.

Exposure applicable in the invention is conducted preferably using a laser scanning exposure apparatus producing longitudinally multiple scanning laser beams, whereby deterioration in image quality such as occurrence of interference fringe-like unevenness is reduced, as compared to a scanning laser beam of the longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

EXAMPLES

The present invention is further described based on examples but embodiments of the present invention are by no means limited to these.

Example 1

Preparation of a Subbed PET Photographic Support

Both surfaces of a biaxially stretched thermally fixed 175 μm PET film, commercially available was subjected to corona discharge at 8 w/m$^2$·min. Onto the surface of one -side, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| | |
|---|---|
| Subbing Coating Composition a-1: | |
| Latex solution (solid 30%) of a copolymer consisting of butyl acrylate (30 weight %), t-butyl acrylate (20 weight %) styrene (25 weight %) and 2-hydroxyethyl-acrylate (25 weight %) | 0.08 g/m$^2$ |
| Hexamethylene-1,6-bis(ethyleneurea) | 0.008 g/m$^2$ |
| Subbing Coating Composition b-1: | |
| Latex liquid (solid portion of 30%) of a copolymer consisting of butyl acrylate (40 weight %) styrene (20 weight %) glycidyl acrylate (25 weight %) | 0.08 g/m$^2$ |
| Hexamethylene-1,6-bis(ethyleneurea) | 0.008 g/m$^2$ |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 μm, which was designated Subbing Layer A-2, while onto the Subbing Layer B-1, the upper subbing layer coating composition b-2 was applied to form a Subbing Upper Layer b-2.

| Upper Subbing Layer Coating Composition a-2: | |
|---|---|
| Gelatin in an amount (weight) to make | 0.4 g/m$^2$ |
| Silica particles (av. size 2 $\mu$m) | 0.01 g/m$^2$ |
| Upper Subbing Layer Coating Composition b-2: | |
| Latex solution of styrene butadiene copolymer (solid 20% comprising) | 0.08 g/m$^2$ |
| Polyethylene glycol (average molecular weight of 900) | 0.036 g/m$^2$ |
| Silica particles (av. size 3 $\mu$m) | 0.01 g/m$^2$ |

Preparation of Silver Halide Emulsion

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A.

Preparation of Powdery Organic Silver Salt

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion (equivalent to 0.038 mol silver) and 450 ml water and stirring further continued for 5 min., while maintained at a temperature of 55° C. Subsequently, 760.6 ml of 1M aqueous silver nitrate solution was added over 2 min. and stirring continued for a further 20 min., then, the reaction mixture was filtered to remove aqueous soluble salts. Thereafter, washing with deionized water and filtration were repeated until the filtrate reached a conductivity of 2 $\mu$S/cm, and finally water was added to make a given concentration.

On the subbed support, the following constituent layers are coated to prepare a photothermographic material sample, in which the light sensitive layer was coated on the A-2 side of the support. Drying was conducted at 75° C. over a period of 1 min.

Light sensitive layer side coating:

1st Layer: Antihalation (AH) Layer

| | |
|---|---|
| Binder (PVB-1, polymerization degree 600) | 1.2 g/m$^2$ |
| Silane compound (Table 1) | 2.3 × 10$^{-4}$ mol/m$^2$ |
| Antihalation dye C1 | 2 × 10$^{-5}$ mol/m$^2$ |

2nd Layer: Light Sensitive Layer

The following composition was dissolved in methyl ethyl ketone and the obtained solution was mixed with a mixture of silver halide and an organic silver salt in an amount of 1.2 g/m$^2$, as a silver content to prepare a coating solution of the light sensitive layer.

| | |
|---|---|
| Binder (PVB-1, polymerization degree 600) | 5.6 g/m$^2$ |
| Silane compound (Table 1) | 9.3 × 10$^{-4}$ mol/m$^2$ |
| Senstizing dye A1 | 2.1 × 10$^{-4}$ mol/m$^2$ |
| Antihalation dye C1 | 1.1 × 10$^{-5}$ mol/m$^2$ |
| Antifoggant 1, pyridinium hydrobromide perbromide | 0.3 mg/m$^2$ |
| Antifoggant 2, isothiazolone | 1.2 mg/m$^2$ |
| Antifoggant 3, 5-methylbenzotriazole | 120 mg/m$^2$ |
| Developer, 1,1-bis(2-hydroxy-3,5-dimethyl phenyl)-3,5,5-trimethylhexane | 3.3 mmol/m$^2$ |

3rd Layer: Interlayer

The following composition was dissolved in methyl ethyl ketone, coated and dried:

| | |
|---|---|
| Binder (PVB-1, polymerization degree 600) | 1.2 g/m$^2$ |
| Silane compound (Table 1) | 2.3 × 10$^{-4}$ mol/m$^2$ |
| 4-Methylphthalic acid | 0.72 g/m$^2$ |
| Tetrachlorophthalic acid | 0.22 g/m$^2$ |
| Tetrachlorophthalic acid anhydride | 0.5 g/m$^2$ |
| Colloidal silica | 0.2 g/m$^2$ |

4th Layer: Protective Layer

| | |
|---|---|
| Binder (cellulose acetate-butylate) | 1.2 g/m$^2$ |
| Silica mating agent (av. size 3 $\mu$m) | 0.5 g/m$^2$ |

On the opposite side to the light sensitive layer, a back layer and its protective layer were coated.

Back Layer Side Coating

1st Layer: Back Layer

| | |
|---|---|
| Binder (PVB-1, polymerization degree 600) | 1.2 g/m$^2$ |
| Silane compound (Table 1) | 2.3 × 10$^{-4}$ mol/m$^2$ |
| Dye C1 | 70 mg/m$^2$ |

2nd Layer: Back Layer-protective Layer

| | |
|---|---|
| Cellulose acetate-butylate | 0.8 g/m$^2$ |
| matting agent (PMMA, av, size 3 $\mu$m) | 0.02 g/m$^2$ |
| Surfactant (N-propylperfluorooctylsulfonamidoacetic acid) | 0.02 g/m$^2$ |

A1

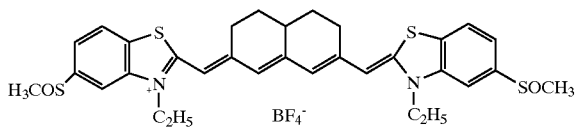

-continued

C1

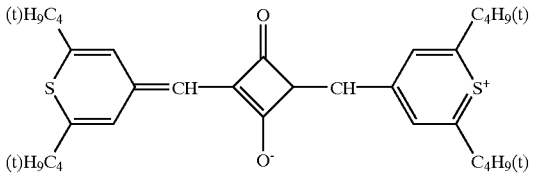

PVB-1

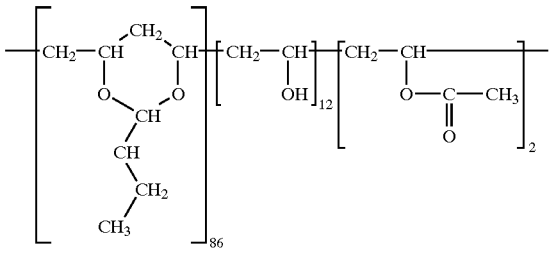

Evaluation of Photographic Performance

Photothermographic material samples were each exposed to semiconductor laser of 810 nm using a laser sensitometer and then thermally developed at a temperature of 120° C. for 8 sec. using a heated drum. The exposure and development were conducted in a room maintained at 25° C. and 50% RH. The processed sample were each subjected to densitometry to evaluate obtained images with respect to sensitivity and fogging. Sensitivity was represented by a relative value of the reciprocal of exposure giving a density of 0.3 plus a fog density, based on the sensitivity of Sample No. 1 being 100. Unexposed samples were each thermally developed and subjected to densitometry to determine the fog density. Contrast was determined from the slope of a tangential line at a density of 1.5 on a characteristic curve. The maximum density was determined by measuring the density corresponding to exposure of 10 times the exposure giving a density of 1.5.

Further, a moisture resistance test was made in the following manner. After being allowed to stand at 23° C. and 50% RH for 3 days, each of the photothermographic material samples were divided into two groups. One of the two groups was allowed to stand at 45° C. and 80% RH for 3 days (i.e., samples aged under high humidity) and the other group was allowed to stand at 23° C. and 50% RH (i.e., samples aged under ordinary humidity). The thus aged samples were exposed and thermally developed to determine the difference in fog density and contrast between samples aged under different conditions. A lower difference in fog and contrast indicates a higher resistance to humidity.

Abrasion resistance was evaluated in such a manner that each sample was abraded with a roller having 3 $\mu$m high protrusions, while loading with a load of 5 kPa and visually evaluated. A level of showing no abrasion mark was graded as "5", a level of showing most numerous abrasion marks was graded as "1" and an intermediate level, acceptable in practical use was graded as "3". The compound used for comparison was $Si(OC_2H_5)_4$. Identical silane compound was incorporated into the 1st, 2nd 3rd layers. Results are shown in Table 2.

TABLE 2

| | Silane | Photographic Performance | | | | Storage Stability | | | |
|---|---|---|---|---|---|---|---|---|---|
| Sample No. | Compd. (Group) | Fog | Sensitivity | Contrast | Max. Density | Difference in Fog | Difference in Contrast | Abrasion Resistance | Remark |
| 101 | — | 0.18 | 100 | 3.3 | 3.3 | 0.03 | 0.04 | 2 | Comp. |
| 102 | C*1 (DF*2) | 0.18 | 100 | 3.4 | 3.3 | 0.02 | 0.03 | 2 | Comp. |
| 103 | 1 (DF) | 0.16 | 102 | 3.5 | 3.4 | 0.01 | 0.02 | 5 | Inv. |
| 104 | 3 (DF) | 0.16 | 102 | 3.5 | 3.4 | 0.01 | 0.02 | 5 | Inv. |
| 105 | 5 (DF) | 0.16 | 102 | 3.5 | 3.4 | 0.01 | 0.02 | 5 | Inv. |
| 106 | 6 (DF) | 0.16 | 102 | 3.5 | 3.4 | 0.01 | 0.02 | 5 | Inv. |
| 107 | 8 (AD*3) | 0.14 | 102 | 3.6 | 3.5 | 0.002 | 0.01 | 5 | Inv. |
| 108 | 9 (AD) | 0.14 | 102 | 3.6 | 3.5 | 0.002 | 0.01 | 5 | Inv. |
| 109 | 11 (NDF*4) | 0.15 | 102 | 3.6 | 3.5 | 0.004 | 0.01 | 5 | Inv. |
| 110 | 21 (AD) | 0.14 | 102 | 3.6 | 3.5 | 0.003 | 0.01 | 5 | Inv. |
| 111 | 22 (AD) | 0.14 | 102 | 3.6 | 3.5 | 0.003 | 0.01 | 5 | Inv. |
| 112 | 35 (DF) | 0.16 | 102 | 3.5 | 3.4 | 0.01 | 0.02 | 5 | Inv. |
| 113 | 38 (DF) | 0.16 | 102 | 3.5 | 3.4 | 0.01 | 0.02 | 5 | Inv. |

*1Comparative compound $Si(OC_2H_5)_4$

*2Diffusible

*3Adsorptive

*4Non-diffusible

As apparent from the Table, it was shown that the use of silane compounds relating to this invention led to photothermographic materials exhibiting reduced fogging, enhanced sensitivity, maximum density and contrast, superior moisture resistance and abrasion resistance.

Example 2

Photothermographic material samples were prepared similarly to Example 1, provided that the compound represented by formula (3) used as a binder was varied with respect to composition. The composition was varied in such a manner that polyvinyl acetate having a polymerization degree of 600 was saponified so that the saponification percentage varied from 70 to 99% to prepare saponified a polyvinyl alcohol. The thus prepared polyvinyl alcohols which were different in saponification value were allowed to react with butyl aldehyde to form a butyral. Acetalization was carried out in the following manner. Thus, to an aqueous 30% (solids) saponified polyvinyl alcohol solution, 10% hydrochloric acid was added and butyl aldehyde was added over a period of 10 min. and was further allowed to react for 6 hrs., while being maintained at a pH of 1.5 and a temperature of 86° C. Precipitated products were dried and washed with ethanol. The acetalization percentage ($d_1$) was determined from the remaining hydroxyl value. Samples were evaluated similarly to Example 1 with respect to performance. Results are shown in Table 3.

TABLE 3

| Sample No. | Silane Compd. | Binder $d_1$ | Binder $d_2$ | Binder $d_3$ | Storage Stability: Difference in Fog | Storage Stability: Sensitivity | Abrasion resistance | Remark |
|---|---|---|---|---|---|---|---|---|
| 201 | 1 | 10 | 88 | 2 | 0.018 | 100 | 5 | Inv. |
| 202 | 1 | 60 | 39 | 1 | 0.016 | 100 | 5 | Inv. |
| 203 | 1 | 70 | 29 | 1 | 0.012 | 100 | 5 | Inv. |
| 204 | 1 | 80 | 19 | 1 | 0.011 | 100 | 5 | Inv. |
| 205 | 1 | 90 | 9 | 1 | 0.011 | 100 | 5 | Inv. |
| 206 | 1 | 86 | 12 | 2 | 0.011 | 100 | 5 | Inv. |
| 207 | 3 | 60 | 39 | 1 | 0.016 | 100 | 5 | Inv. |
| 208 | 3 | 70 | 29 | 1 | 0.014 | 100 | 5 | Inv. |
| 209 | 3 | 80 | 19 | 1 | 0.011 | 100 | 5 | Inv. |
| 210 | 3 | 90 | 9 | 1 | 0.011 | 100 | 5 | Inv. |
| 211 | 5 | 10 | 80 | 10 | 0.018 | 100 | 5 | Inv. |
| 212 | 5 | 30 | 50 | 20 | 0.018 | 100 | 5 | Inv. |
| 213 | 5 | 50 | 20 | 30 | 0.016 | 100 | 5 | Inv. |
| 214 | 5 | 80 | 18 | 2 | 0.011 | 100 | 5 | Inv. |
| 215 | 5 | 90 | 8 | 2 | 0.011 | 100 | 5 | Inv. |

As can be seen from the results, the use of silane compounds and butyrals relating to this invention led to enhanced storage stability and abrasion resistance.

Example 3

Photothermographic material samples were prepared similarly to Example 2, provided that intermolecularly acetalized binders were used. Intermolecular acetalization was carried out in a manner such that saponified polyvinyl alcohol was dissolved in aqueous acetone solution (water:acetone=1:1) so as to form a 76% solids solution and butyl aldehyde was dropwise added over a period of 10 min. at a pH of 1.5 and a temperature of 96° C. to undergo acetalization. The acetalization percentage was determined by determining the molecular weight through viscometry. Thus, a 1% solids saponified polyvinyl alcohol, the intermolecular acetalization percentage of which was negligible was subjected to acetalization and the molecular weight of the product was determined through viscometry. Similarly, a relatively high solids percent polyvinyl alcohol was acetalized to determine the molecular weight of the product. Acetalization percentage was determined from the difference in molecular weight between both products.

The thus prepared samples were evaluated similarly to Example 1. The samples were further evaluated with respect to unevenness in development. Thus, a sample of 35×43 cm was fully exposed to a 810 nm laser so as to give a density of 1.0, developed at 120° C. for 8 sec., and visually evaluated on a viewing box with respect to unevenness in density, based on the level of no unevenness in density, due to coating being observed, graded as "5", a level acceptable in practical use, graded as "3" and the level of marked unevenness, graded as "1". Unevenness due to thermal development was excluded from the evaluation. Results are shown in Table 4.

TABLE 4

| Sample No. | Silane Compd. | Binder $d_1$ | Binder $d_2$ | Binder $d_3$ | Binder $d_4$ | Storage Stability: Difference in Fog | Storage Stability: Sensitivity | Abrasion resistance | Abrasion Uneven ness | Remark |
|---|---|---|---|---|---|---|---|---|---|---|
| 301 | 1 | 86 | 12 | 1 | 0 | 0.018 | 100 | 5 | 3 | Inv. |
| 302 | 1 | 86 | 12 | 1 | 1 | 0.016 | 100 | 5 | 3 | Inv. |
| 303 | 1 | 86 | 12 | 1 | 2 | 0.012 | 100 | 5 | 3 | Inv. |
| 304 | 1 | 86 | 12 | 1 | 5 | 0.011 | 100 | 5 | 4 | Inv. |
| 305 | 1 | 81 | 12 | 1 | 6 | 0.011 | 100 | 5 | 4 | Inv. |
| 306 | 1 | 79 | 12 | 1 | 8 | 0.011 | 100 | 5 | 5 | Inv. |
| 307 | 1 | 67 | 12 | 1 | 20 | 0.009 | 100 | 5 | 5 | Inv. |
| 308 | 1 | 62 | 12 | 1 | 25 | 0.009 | 100 | 5 | 5 | Inv. |
| 309 | 1 | 57 | 12 | 1 | 30 | 0.009 | 100 | 5 | 5 | Inv. |
| 310 | 3 | 86 | 12 | 2 | 1 | 0.011 | 100 | 5 | 3 | Inv. |
| 311 | 3 | 77 | 12 | 2 | 10 | 0.011 | 100 | 5 | 4 | Inv. |
| 312 | 3 | 67 | 12 | 2 | 20 | 0.009 | 100 | 5 | 5 | Inv. |
| 313 | 3 | 57 | 12 | 2 | 30 | 0.009 | 100 | 5 | 5 | Inv. |
| 314 | 5 | 85 | 12 | 2 | 10 | 0.011 | 100 | 5 | 4 | Inv. |
| 315 | 5 | 85 | 12 | 2 | 20 | 0.009 | 100 | 5 | 5 | Inv. |

As can be seen from the results, the use of silane compounds and intermolecularly acetalized polymers led to thermographic materials exhibiting superior storage stability and abrasion resistance, while unevenness in density was also improved.

Example 4

Photothermographic material samples were prepared similary to Example 1, provided that on a subbed support the light sensitive layer-side was coated by water-based coating using latexes and gelatin as a binder. Used as a binder for comparison was polyvinyl alcohol having a polymerization degree of 500 and a saponification degree of 99% (also denoted as PVA*). The composition of the light sensitive layer side is shown below. Silane compounds used in respective layers were identical. The 1st to 4th layers were simultaneously coated at a coating speed of 200 m/min. and dried for 3 min.

Light Sensitive Layer Side Composition

1st Layer: Antihalation (AH) Layer

| | |
|---|---|
| Binder: latex shown in Table 5 | 1.2 g/m$^2$ |
| Silane compound (Table 5) | $2.3 \times 10^{-4}$ mol/m$^2$ |
| Antihalation dye C2 | $2 \times 10^{-5}$ mol/m$^2$ |

2nd Layer: Light Sensitive Layer

The following composition was dissolved or dispersed in aqueous solution to obtain a coating solution of the light sensitive layer. A mixture of silver halide and an organic silver salt in an amount of 1.3 g/m$^2$, as a silver content was mixed with a latex shown in Table 5.

| | |
|---|---|
| Binder: latex shown in Table 5 | 5.6 g/m$^2$ |
| Silane compound (Table 5) | $2.2 \times 10^{-4}$ mol/m$^2$ |

-continued

| | |
|---|---|
| Sensitizing dye A2 | 2 mg/m$^2$ |
| Antifoggant 1, pyridinium hydrobromide perbromide | 0.3 mg/m$^2$ |
| Antifoggant 2, isothiazolone | 1.2 mg/m$^2$ |
| Antifoggant 3, 5-methylbenzotriazole | 120 mg/m$^2$ |
| Developer, 1,1-bis(2-hydroxy-3,5-dimethyl phenyl)-3,5,5-trimethylhexane | 3.3 mmol/m$^2$ |

3rd Layer: Interlayer

The following composition was dissolved in methyl ethyl ketone, coated and dried:

| | |
|---|---|
| Binder: latex shown in Table 5 | 1.2 g/m$^2$ |
| Silane compound (Table 5) | 2.3 × 10$^{-4}$ mol/m$^2$ |
| 4-Methylphthalic acid | 0.72 g/m$^2$ |
| Tetrachlorophthalic acid | 0.22 g/m$^2$ |
| Tetrachlorophthalic acid anhydride | 0.5 g/m$^2$ |
| Colloidal silica | 0.2 g/m$^2$ |

4th Layer: Protective Layer

| | |
|---|---|
| Binder: alkali-processed inert gelatin | 1.2 g/m$^2$ |
| 4-Methylphthalic acid | 0.72 g/m$^2$ |
| Tetrachlorophthalic acid | 0.22 g/m$^2$ |
| Tetrachlorophthalic acid anhydride | 0.5 g/m$^2$ |
| Silica mating agent (av. size 5 μm) | 0.5 g/m$^2$ |
| hexamethylene diisocyanate | 0.3 g/m$^2$ |

A2

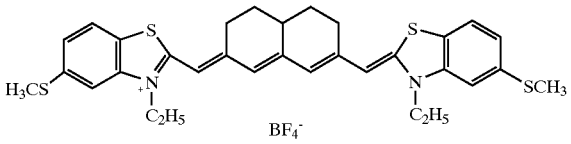

-continued

C2

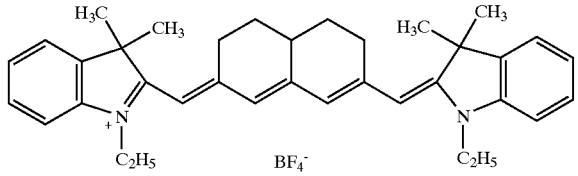

Samples were evaluated similarly to Example 1. Results are shown in Table 5.

TABLE 5

| Sample No. | Silane Compd. (Group) | Binder Latex | Photographic Performance: Fog | Sensitivity | Contrast | Max. Density | Storage Stability: Difference in Fog | Difference in Contrast | Abrasion Resistance | Remark |
|---|---|---|---|---|---|---|---|---|---|---|
| 401 | — | PVA* | 0.19 | 100 | 3.3 | 3.3 | 0.04 | 0.04 | 2 | Comp. |
| 402 | C*1 (DF*2) | L5 | 0.18 | 100 | 3.3 | 3.3 | 0.03 | 0.03 | 2 | Comp. |
| 403 | 1 (DF) | L5 | 0.17 | 102 | 3.4 | 3.4 | 0.02 | 0.02 | 5 | Inv. |
| 404 | 3 (DF) | L5 | 0.17 | 102 | 3.4 | 3.4 | 0.02 | 0.02 | 5 | Inv. |
| 405 | 5 (DF) | L5 | 0.17 | 102 | 3.4 | 3.4 | 0.02 | 0.02 | 5 | Inv. |
| 406 | 6 (DF) | L5 | 0.17 | 102 | 3.4 | 3.4 | 0.02 | 0.02 | 5 | Inv. |
| 407 | 8 (AD*3) | L2 | 0.16 | 102 | 3.5 | 3.5 | 0.01 | 0.01 | 5 | Inv. |
| 408 | 9 (AD) | L2 | 0.16 | 102 | 3.5 | 3.5 | 0.01 | 0.01 | 5 | Inv. |
| 409 | 11 (NDF*4) | L2 | 0.15 | 102 | 3.5 | 3.5 | 0.01 | 0.01 | 5 | Inv. |
| 410 | 21 (AD) | L2 | 0.16 | 102 | 3.5 | 3.5 | 0.01 | 0.01 | 5 | Inv. |
| 411 | 22 (AD) | L12 | 0.16 | 102 | 3.5 | 3.5 | 0.01 | 0.01 | 5 | Inv. |
| 412 | 35 (DF) | L16 | 0.17 | 102 | 3.4 | 3.4 | 0.02 | 0.02 | 5 | Inv. |
| 413 | 38 (DF) | L18 | 0.17 | 102 | 3.4 | 3.4 | 0.02 | 0.02 | 5 | Inv. |

*1Comparative compound $Si(OC_2H_5)_4$
*2Diffusible
*3Adsorptive
*4Non-diffusible As can be seen from the Table, even in the water-based coating by the use of latexes, the use of the compounds relating to this invention led to superior storage stability and abrasion resistance.

Example 5

Photothermographic material samples were prepared similarly to Sample No. 103 of Example 1. Three layers were simultaneously coated using a vacuum extrusion coater, as shown in FIG. 2, in which coating solutions of the 1st, 2nd and 3rd layers of the light sensitive layer side were added into $T_1$, $T_2$ and $T_3$, respectively to perform simultaneous multi-layer coating. Viscosity of each coating solution and the degree of reduced pressure in the reduced pressure chamber (i.e., the difference between atmospheric pressure and reduced pressure in the reduced pressure chamber, expressed in hPa) were varied. A bulkhead was also provided in the reduced pressure chamber and the shape, average diameter and opening area ratio of the penetration pores (i.e., percentage of total penetration pore area, based on the bulkhead area) were each varied, as shown in Table 6. The viscosity (expressed in mPa·s unit) was adjusted by varying the solids percentage of the coating solution and by mixing an intermolexularly acetalized binder (as shown in Sample Nos. 304 through 309 of Example 3). In the die, a stabilizing chamber to stabilize supply of the coating solution, having circular section (i.e., spherical chamber) was employed. Coating was carried out at a coating speed of 100 m/min and dried for 3 min. at a temperature of 40° C.

The thus prepared samples were each cut to 35×43 cm, thermally developed and evaluated with respect to uniformity in coating. Thus, samples were fully exposed so as to give a density of 1.0 and developed. Densities of each of the developed samples were each measured at intervals of 5 mm and a standard deviation of density was determined. Uniformity in coating was evaluated based on the value of the standard deviation of density divided by an average density and multiplied by 100. A lower value indicates more uniform coating. Results thereof are shown in Table 6.

TABLE 6

| Experiment No. | Viscosity (mPa · s) 1st Layer | 2nd Layer | 3rd layer | Reduced Pressure Degree | Bulkhead Penetration Pore | Av. Diameter | Opening Area Ratio | Uniformity in coating | Remark |
|---|---|---|---|---|---|---|---|---|---|
| 501 | 80 | 15 | 15 | 0 | Lattice | 30 μm | 60 | 50 | Inv. |
| 502 | 80 | 15 | 15 | 50 | Lattice | 30 μm | 60 | 50 | Inv. |
| 503 | 15 | 80 | 80 | 50 | Lattice | 30 μm | 60 | 5 | Inv. |
| 504 | 15 | 80 | 80 | 100 | Lattice | 30 μm | 60 | 6 | Inv. |
| 505 | 15 | 80 | 80 | 200 | Lattice | 30 μm | 60 | 8 | Inv. |
| 506 | 15 | 80 | 80 | 300 | Lattice | 30 μm | 60 | 8 | Inv. |
| 507 | 15 | 80 | 80 | 400 | Lattice | 30 μm | 60 | 6 | Inv. |
| 508 | 15 | 80 | 80 | 500 | Lattice | 30 μm | 60 | 50 | Inv. |
| 509 | 15 | 80 | 80 | 600 | Lattice | 30 μm | 60 | 60 | Inv. |
| 510 | 15 | 100 | 100 | 100 | Lattice | 30 μm | 60 | 5 | Inv. |
| 511 | 15 | 300 | 300 | 80 | Lattice | 30 μm | 60 | 5 | Inv. |
| 512 | 15 | 1000 | 1000 | 80 | Lattice | 30 μm | 60 | 5 | Inv. |
| 513 | 15 | 3000 | 3000 | 80 | Lattice | 30 μm | 60 | 5 | Inv. |
| 514 | 15 | 5000 | 5000 | 80 | Lattice | 30 μm | 60 | 5 | Inv. |
| 515 | 30 | 1000 | 1000 | 80 | Lattice | 30 μm | 60 | 5 | Inv. |
| 516 | 30 | 1000 | 1000 | 80 | Circle | 30 μm | 60 | 5 | Inv. |
| 517 | 30 | 1000 | 1000 | 80 | Honeycomb | 30 μm | 60 | 5 | Inv. |
| 518 | 30 | 1000 | 1000 | 80 | Honeycomb | 30 μm | 60 | 5 | Inv. |
| 519 | 30 | 1000 | 1000 | 80 | Honeycomb | 30 μm | 60 | 5 | Inv. |
| 520 | 30 | 1000 | 1000 | 80 | Honeycomb | 30 μm | 60 | 5 | Inv. |
| 521 | 30 | 1000 | 1000 | 80 | Lattice | 30 μm | 60 | 5 | Inv. |
| 522 | 30 | 1000 | 1000 | 80 | Lattice | 30 μm | 60 | 5 | Inv. |
| 523 | 30 | 1000 | 1000 | 80 | — | 30 μm | 60 | 90 | Inv. |
| 524 | 30 | 1000 | 1000 | 80 | Lattice | 30 μm | 80 | 5 | Inv. |
| 525 | 30 | 1000 | 1000 | 80 | Lattice | 20 μm | 60 | 5 | Inv. |
| 526 | 30 | 1000 | 1000 | 80 | Lattice | 10 μm | 60 | 5 | Inv. |
| 527 | 30 | 1000 | 1000 | 80 | Lattice | 100 μm | 60 | 6 | Inv. |
| 528 | 30 | 1000 | 1000 | 80 | Lattice | 200 μm | 65 | 7 | Inv. |
| 529 | 30 | 1000 | 1000 | 80 | Lattice | 600 μm | 70 | 8 | Inv. |

In the coater, the adjustment of viscosity of the coating solutions and the degree of reduced pressure and the use of the bulkhead having penetration pores led to enhanced uniform coating.

Example 6

Coating was carried out similarly to Experiment No. 504 in Example 5, provided that addition vessels $T_6$ through $T_{10}$ were further provided at the pipes midway between addition vessels $T_1$ through $T_5$ and the die and silane compounds relating to this invention were supplied by a pump and mixed by a static mixer so as to form a turbulent flow. Coating solutions were maintained at 25° C. and the silane compounds were each dissolved in methyl ethyl ketone so as to form a 10% solids solution, maintained at 25° C. After start of the coating, coating solutions which were each supplied from addition vessel $T_1$ through $T_3$ at a rate suited for the coating speed, were each mixed with the silane compound solution flow, extruded from the die and coated on the subbed support. After continuously carrying out coating for 48 hrs., the coated sample was exposed so as to give a density of 1.0 and evaluated with respect to coagulates and uniformity in coating. Results are shown in Table 7.

TABLE 7

| Experiment No. | Coating temperature | Mixing Time | Coagulate | Coating Uniformity | Remark |
|---|---|---|---|---|---|
| 601 | 2 | 48 hr | Yes | 47 | Inv. |
| 602 | 6 | 48 hr | Yes | 46 | Inv. |
| 603 | 20 | 1 sec | No | 6 | Inv. |
| 604 | 40 | 1 sec | No | 6 | Inv. |
| 605 | 60 | 1 sec | No | 47 | Inv. |
| 606 | 20 | 1 hr | No | 12 | Inv. |
| 607 | 20 | 20 min. | No | 8 | Inv. |
| 608 | 20 | 8 | No | 7 | Inv. |

As shown in the Table, it was proved that when the coating solution was maintained at a temperature of 5 to 50° C. and the silane compound was mixed with the coating solution within 10 min. to perform coating, no coagulate was produced and uniform coating was achieved.

Example 7

Coating was carried out similarly to Experiment No. 603 Example 6, provided that the shape of the chamber to stabilize supply of a coating solution, provided in the die. the chamber was designed so as to have a capacity of 3 times the supplying amount of the coating solution. Uniformity in coating was evaluated similarly to Example 5. Results are shown Table 8.

TABLE 8

| Experiment No. | Shape | Coating uniformity | Remark |
|---|---|---|---|
| 701 | Sphere | 6 | Inv. |
| 702 | Ellipsoid | 5 | Inv. |
| 703 | Spindle | 5 | Inv. |
| 704 | Cube | 7 | Inv. |
| 705 | Rectangle | 7 | Inv. |

As apparent from the Table, when the chamber to stabilize supply of the coating solution was in the form of an ellipsoid, spindle, cube or rectangle, enhanced uniformity in coating was achieved.

Example 8

Coating was carried out similarly to Experiment No. 702 in Example 7, provided that the central control mechanism was provided to control a means for controlling supply of a coating solution, a means for controlling the reduced pressure in the reduced pressure chamber, a means for controlling the rotation speed of the support-driving roll and a discharge treatment means.

At the initial stage of coating with accelerating the coating speed from 0 to 100 m/min, it is the conventional case that the coating solution is supplied at a rate responsible coating speed of 100 m/min and when being stabilized, the coating solution is supplied to the support to perform coating. In this experiment, however, coating could be started from the initial stage with supplying the coating solution from the die. The discharge treatment was conducted at a discharge of 8 W/min·m, the pressure reduction was conducted at a rate of 1 hPa/m and the total solution supply was conducted at a coating area of 100 cm/m. Coupling the supply of coating solutions, the level of the reduced pressure, the discharge treatment and the support-driving roll to the central control enabled coating even during the period until reached a constant coating speed.

Example 9

Coating was carried out similarly to Experiment No. 503 in Example 5, provided that the subbed support was replaced by a support which was subjected to a plasma treatment without being subbed and to a discharging treatment before and after the plasma treatment. The used charge neutralizer was (a) a blower-type discharger (KD-410, available from KASUGA DENKI Co., Ltd.), (b) a brush-type discharger (available from Achilles Nonspark Co.) and (c) a high density discharger (HDIS-400, available from KASUGA DENKI Co., Ltd.). Argon gas was employed as an inert gas in the plasma treatment. Thus, the plasma treatment was conducted with supplying argon at a rate 400 ml/min and oxygen at a rate of 2 ml/min. under the pressure of 400 Pa, using a microwave of 2.45 GHz. Coatability was evaluated similarly to example 5. Results are shown in Table 9.

TABLE 9

| Experiment No. | Plasma Treatment | Pre-discharging | Post-discharging | Coating uniformity | Remark |
|---|---|---|---|---|---|
| 801 | No | No | No | 50 | Inv. |
| 802 | Yes | No | No | 20 | Inv. |
| 803 | Yes | a | a | 4 | Inv. |
| 804 | Yes | b | b | 3 | Inv. |
| 805 | Yes | c | c | 2 | Inv. |
| 806 | Yes | No | c | 8 | Inv. |
| 807 | Yes | c | No | 8 | Inv. |

As can be seen from the Table, the plasma treatment in combination with the discharge treatment led to further enhanced coatability.

Example 10

Photothermographic material samples were prepared similarly to Example 4, provided that the following layers were coated on the light sensitive layer side of the support by simultaneous five-layer coating method, in place of the simultaneous three-layer coating method employed in Example 5. Coating was done using a vertically falling type vacuum extrusion coater, as shown in FIG. 2 at a coating speed of 100 m/min and drying was done at a drying temperature of 40° C. period of 2 min. 40 sec. A silane compound was added into addition vessel $T_8$ and $T_9$ so that the silane compound was mixed with the coating solution of the 3rd or 4th layer within 3 sec. The degree of the reduced pressure and the condition of the bulkhead were the same as in Experiment 504 in example 5 and the viscosity was adjusted by adjusting the solids percentage of the coating solution and using a thickening agent, poly(sodium styrenesulfonate) having a weight-average molecular weight of 560,000. The used-silane compounds, the viscosity of each layer, and evaluation of coatability and abrasion resistance are shown in Table 10.

1st Layer (1st Adhesion Layer)

| | |
|---|---|
| Vinylidene chloride itaconic acid copolymer latex (99.9:0.1 by weight %) molecular weight of 25000, 2% solids | 0.45 g/m$^2$ |

2nd Layer (AH Layer)

| | |
|---|---|
| Vinylidene chloride acrylic acid copolymer latex (92.5:7.5 by weight %) | 0.55 g/m$^2$ |
| Antihalation dye C2 | $2 \times 10^{-5}$ mol/m$^2$ |

3rd Layer: Light Sensitive Layer

The following composition was dissolved or dispersed in aqueous solution to obtain a coating solution of the light sensitive layer. A mixture of silver halide and an organic silver salt in an amount of 1.3 g/m$^2$, as a silver content was mixed with a latex shown below (40% solids).

| | |
|---|---|
| Sensitizing dye A2 | 2 mg/m$^2$ |
| Antihalation dye C2 | $1 \times 10^{-5}$ mol/m$^2$ |

-continued

| | |
|---|---|
| Antifoggant 1, pyridinium hydrobromide perbromide | 0.3 mg/m$^2$ |
| Antifoggant 2, isothiazolone | 1.2 mg/m$^2$ |
| Antifoggant 3, 5-methylbenzotriazole | 120 mg/m$^2$ |
| Silane compound (Table 10) | 2.2 × 10$^{-4}$ mol/m$^2$ |
| Developer, 1,1-bis(2-hydroxy-3,5-dimethyl phenyl)-3,5,5-trimethylhexane | 3.3 mmol/m$^2$ |
| Styrene-butadiene copolymer (60:40 by weight %) | 5.6 g/m$^2$ |

4th Layer: Interlayer

The following composition was dissolved in methyl ethyl ketone, coated and dried:

| | |
|---|---|
| Binder: vinylidene chloride itaconic acid copolymer (99:1% by weight) weight0average molecular weight | 1.2 g/m$^2$ |
| Silane compound (Table 10) | 2.3 × 10$^{-4}$ mol/m$^2$ |
| 4-Methylphthalic acid | 0.72 g/m$^2$ |
| Tetrachlorophthalic acid | 0.22 g/m$^2$ |
| Tetrachlorophthalic acid anhydride | 0.5 g/m$^2$ |
| Colloidal silica | 0.2 g/m$^2$ |

5th Layer: Protective Layer

| | |
|---|---|
| Binder: alkali-processed inert gelatin | 1.2 g/m$^2$ |
| 4-Methylphthalic acid | 0.72 g/m$^2$ |
| Tetrachlorophthalic acid | 0.22 g/m$^2$ |
| Tetrachlorophthalic acid anhydride | 0.5 g/m$^2$ |
| Silica mating agent (av. size 5 $\mu$m) | 0.5 g/m$^2$ |
| hexamethylene diisocyanate | 0.3 g/m$^2$ |
| Perfluorooctylsulfonamide sodium acetate salt | 0.02 g/m$^2$ |

TABLE 10

| Experiment No. | Silane compd. | Viscosity (mPa · s) 1st Layer | 2nd Layer | 3rd Layer | 4th Layer | 5th Layer | Coating Uniformity | Abrasion resistance | Remark |
|---|---|---|---|---|---|---|---|---|---|
| 1001 | — | 15 | 1000 | 1000 | 1000 | 80 | 46 | 2 | Comp. |
| 1002 | — | 60 | 1000 | 1000 | 1000 | 200 | 67 | 2 | Comp. |
| 1003 | — | 80 | 1000 | 1000 | 80 | 15 | 38 | 2 | Comp. |
| 1004 | 1 | 80 | 1000 | 1000 | 1000 | 80 | 8 | 5 | Inv. |
| 1005 | 1 | 200 | 1000 | 1000 | 1000 | 200 | 22 | 5 | Inv. |
| 1006 | 1 | 15 | 1000 | 1000 | 80 | 15 | 6 | 5 | Inv. |
| 1007 | 2 | 30 | 2000 | 2000 | 60 | 20 | 6 | 5 | Inv. |
| 1008 | 2 | 30 | 100 | 100 | 80 | 30 | 6 | 5 | Inv. |
| 1009 | 2 | 30 | 200 | 200 | 80 | 30 | 6 | 5 | Inv. |
| 1010 | 2 | 30 | 300 | 300 | 80 | 30 | 6 | 5 | Inv. |
| 1011 | 2 | 30 | 400 | 400 | 80 | 30 | 6 | 5 | Inv. |
| 1012 | 3 | 30 | 500 | 200 | 80 | 30 | 6 | 5 | Inv. |
| 1013 | 3 | 30 | 800 | 100 | 80 | 30 | 6 | 5 | Inv. |
| 1014 | 3 | 30 | 200 | 500 | 80 | 30 | 6 | 5 | Inv. |
| 1015 | 5 | 30 | 100 | 800 | 80 | 30 | 6 | 5 | Inv. |
| 1016 | 5 | 30 | 30 | 700 | 80 | 30 | 6 | 5 | Inv. |
| 1017 | 5 | 30 | 30 | 600 | 80 | 30 | 6 | 5 | Inv. |

As can be seen from the Table, it was proved that in simultaneous multi-layer coating by using a silane compounds and vacuum extrusion coater, enhanced abrasion resistance and superior uniformity in coating were achieved by maintaining viscosities of the 1st layer and light sensitive layer at 100 mPa·s or less and 100 mPa·s or more, respectively.

What is claimed is:

1. A photothermographic material comprising, on a support, light sensitive silver halide grains, an organic silver salt, a reducing agent, a silane compound and a binder, wherein the silane compound is represented by formula (1) or (2):

formula (1):

$$(R^1O)_m—Si—[(L_1)_xR^2]_n$$

formula (2):

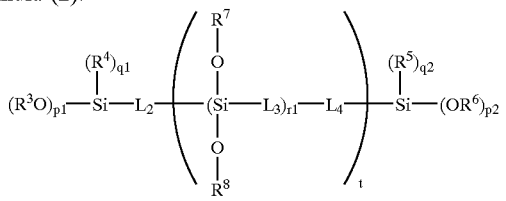

wherein $R^1$, $R^2$, $R^3$, $R^4$, $R^5$, $R^6$, $R^7$ and $R^8$ represent each an alkyl group, an alkenyl group, an alkynyl group, an aryl group or a heterocyclic group; $L_1$, $L_2$, $L_3$ and $L_4$ represent each a bivalent linkage group; m and n are each an integer of 1 to 3, provided that m+n is 4, p1 and p2 are each an integer of 1 to 3 and q1 and q2 are each 0, 1 or 2, provided that p1+q1 and p2+q2 are each 3; r1 and t are each 0 or an integer of 1 to 1000; and x is 0 or 1; and wherein the binder is represented by formula (3):

formula (3):

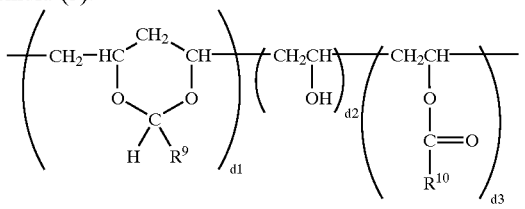

wherein $R^9$ and $R^{10}$ each represent an alkyl group, an alkenyl group, an aryl group or a heterocyclic group; d1, d2 and d3 represent a constitution ratio and d1 is 20 to 96% by weight, d2 is 1 to 40% by weight and d3 is 0.1 to 60% by weight.

2. The photothermographic material of claim 1, wherein in formula (1) or (2), at least one of $R^1$ and $R^2$ or at least one of $R^3$, $R^4$, $R^5$, $R^6$, $R^7$ and $R^8$ is a ballast group or an adsorption-promoting group.

3. The photothermographic material of claim 2, wherein said ballast group is at least one selected from the group consisting of an aliphatic group having 6 or more carbon atoms and an aryl group substituted with an alkyl group having 3 or more carbon atoms; and said adsorption-promoting group is at least one selected from the group consisting of a primary, secondary or tertiary amino group, an imidazole group, an oxazole group, a thiazole group and a tetrazole group.

4. The photothermographic material of claim 1, wherein the photothermographic material comprises a silane compound represented by formula (1).

5. The photothermographic material of claim 4, wherein in formula (1), $R^2$ is a ballast group or an adsorption-promoting group.

6. The photothermographic material of claim 5, wherein said ballast group is at least one selected from the group consisting of an aliphatic group having 6 or more carbon atoms and an aryl group substituted with an alkyl group having 3 or more carbon atoms; and said adsorption-promoting group is at least one selected from the group consisting of a primary, secondary or tertiary amino group, an imidazole group, an oxazole group, a thiazole group and a tetrazole group.

7. The photothermographic material of claim 1, wherein the photothermographic material further comprises a binder represented by formula (4):

formula (4):

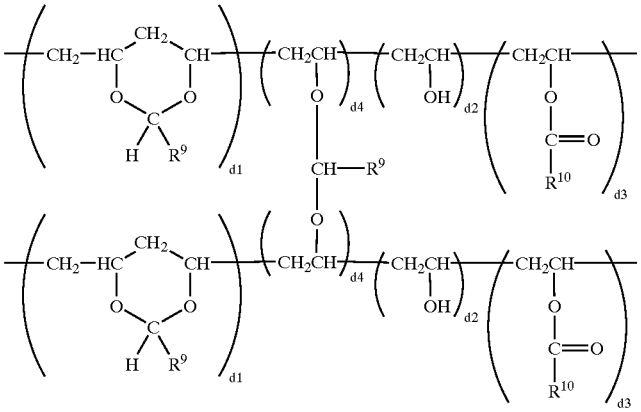

wherein $R^9$, $R^{10}$, d1, d2 and d3 are the same as defined in formula (3), and d4 represents a percentage by weight of intermolecular acetal.

8. The photothermographic material of claim 1, wherein the photothermographic material comprises a light sensitive layer on the support, the light sensitive layer or a layer adjacent to the light sensitive layer comprises a polymer latex comprising at least one monomer unit selected from the group consisting of styrene, butadiene, methyl methacrylate and vinylidene chloride.

* * * * *